US007922628B2

(12) United States Patent
Gonzalez

(10) Patent No.: US 7,922,628 B2
(45) Date of Patent: Apr. 12, 2011

(54) MARTIAL ARTS PRACTICE ASSEMBLY

(76) Inventor: Angel Gonzalez, Miami, FL (US)

( * ) Notice: Subject to any disclaimer, the term of this patent is extended or adjusted under 35 U.S.C. 154(b) by 0 days.

(21) Appl. No.: 12/228,674

(22) Filed: Aug. 14, 2008

(65) Prior Publication Data

US 2009/0098985 A1 Apr. 16, 2009

Related U.S. Application Data

(63) Continuation-in-part of application No. 11/471,433, filed on Jun. 20, 2006, now abandoned, which is a continuation-in-part of application No. 11/401,072, filed on Apr. 10, 2006, now abandoned, which is a continuation-in-part of application No. 11/358,287, filed on Feb. 21, 2006, now abandoned.

(51) Int. Cl.
*A63B 69/22* (2006.01)
*A63B 69/24* (2006.01)
*A63B 69/34* (2006.01)

(52) U.S. Cl. ..... 482/90; 482/83; 482/87

(58) Field of Classification Search ..... 482/90, 482/83, 86, 111, 33, 87, 88; D21/722, 798; 211/13.1, 85.7; 248/121; 446/222
See application file for complete search history.

(56) References Cited

U.S. PATENT DOCUMENTS 1,453,035 A 4/1923 Williams
2,319,109 A * 5/1943 Bulloch ..... 482/148
3,804,406 A 4/1974 Viscione
3,841,631 A 10/1974 Dolan
3,923,302 A 12/1975 Boggild
4,572,504 A * 2/1986 DiBartolo ..... 482/83
4,662,630 A 5/1987 Dignard et al.
4,749,184 A 6/1988 Tobin
4,765,609 A 8/1988 Wilson et al.
4,913,419 A 4/1990 McAuliffe
4,973,045 A 11/1990 Heberer
5,013,039 A 5/1991 Cole
5,183,451 A 2/1993 Hautamaki
5,256,069 A 10/1993 Snowden, Jr. et al.
5,342,267 A 8/1994 Adams et al.
5,352,170 A 10/1994 Condo et al.
5,389,057 A * 2/1995 Zagata, Jr. ..... 482/83
5,458,305 A * 10/1995 Woodward ..... 248/121
5,458,552 A * 10/1995 Mara ..... 482/83
5,472,395 A * 12/1995 Trocchio ..... 482/83
5,476,433 A 12/1995 Bruner
5,554,088 A * 9/1996 Zlojutro ..... 482/83
5,665,035 A * 9/1997 Tumminia ..... 482/83
5,679,103 A 10/1997 Pratchett
5,688,212 A * 11/1997 Walker ..... 482/83
5,700,230 A 12/1997 Cardona
(Continued)

*Primary Examiner* — Loan Thanh
*Assistant Examiner* — Sundhara M Ganesan
(74) *Attorney, Agent, or Firm* — Malloy & Malloy, P.A.

(57) ABSTRACT

An assembly structured to facilitate the practice of various martial art techniques by an individual such as kicks, punches and other physically delivered blows associated with various forms of the martial arts. At least one elongated stanchion is operatively supported by a base, preferably having a stabilizing assembly, in a substantially vertical, upright position. The stanchion comprises a plurality of support assemblies extending outwardly therefrom and being adjustable at various heights along the length thereof. Each or a predetermined number of the support assemblies include a mounting structure secured to an outer end thereof at a predetermined orientation. Each of the mounting structures is dimensioned, disposed and configured to have a striking target, such as a Thai pad, or like structure disposed in an exposed, accessible location to facilitate the delivery, by the individual, of different types of martial art blows.

5 Claims, 16 Drawing Sheets

U.S. PATENT DOCUMENTS

| | | | | |
|---|---|---|---|---|
| 5,722,920 | A | 3/1998 | Bauer | |
| 5,863,278 | A | 1/1999 | Chen | |
| D408,476 | S | 4/1999 | Howachyn et al. | |
| 5,897,465 | A | 4/1999 | Hautamaki | |
| 5,899,835 | A | 5/1999 | Puranda | |
| 5,924,930 | A | 7/1999 | Stewart | |
| 5,944,639 | A | 8/1999 | Ray | |
| 6,080,089 | A | 6/2000 | Nicholson | |
| D434,299 | S * | 11/2000 | McAtee | D8/71 |
| 6,152,863 | A | 11/2000 | Nelson et al. | |
| 6,220,992 | B1 * | 4/2001 | Shafik | 482/83 |
| 6,309,327 | B1 | 10/2001 | Hallberg | |
| 6,325,747 | B1 * | 12/2001 | Norblom | 482/83 |
| 6,348,028 | B1 | 2/2002 | Cragg | |
| 6,416,445 | B1 | 7/2002 | Nelson et al. | |
| 6,736,764 | B1 | 5/2004 | Kapustka | |
| 6,991,568 | B1 | 1/2006 | Tien | |
| 7,086,997 | B1 | 8/2006 | Fields et al. | |
| 7,121,986 | B1 * | 10/2006 | O'Dowd | 482/83 |
| 7,246,463 | B1 * | 7/2007 | Arnot | 47/42 |
| 7,300,388 | B2 * | 11/2007 | Sams, III | 482/89 |
| 2002/0010057 | A1 * | 1/2002 | Bouvier | 482/86 |
| 2004/0176222 | A1 | 9/2004 | Mitchell | |
| 2004/0214694 | A1 * | 10/2004 | Borreca | 482/83 |
| 2005/0003936 | A1 * | 1/2005 | Schwendemann | 482/87 |
| 2007/0197349 | A1 | 8/2007 | Gonzalez | |
| 2007/0197350 | A1 | 8/2007 | Gonzalez | |
| 2007/0197351 | A1 | 8/2007 | Gonzalez | |

* cited by examiner

MARTIAL ARTS PRACTICE ASSEMBLY

CLAIM OF PRIORITY

The present application is a Continuation-In-Part application of previously filed, application having Ser. No. 11/471,433, which was filed on Jun. 20, 2006 now abandoned, which is a Continuation-In-Part application of then application having Ser. No. 11/401,072, filed on Apr. 10, 2006 and now abandoned application, which is a Continuation-In-Part application of then application having Ser. No. 11/358,287, filed on Feb. 21, 2006 and now abandoned application, wherein all of the above are incorporated herein in their entirety by reference.

BACKGROUND OF THE INVENTION

1. Field of the Invention

This invention relates to a post-like assembly for the removable support and selective disposition of a plurality of striking targets such as, but not limited to, Thai pads. Selective adjustability and other structural features of the post-like assembly facilitate the positioning of the striking targets in a preferred, exposed, accessible location and at predetermined orientations so as to facilitate the execution of various types of kicks, punches and other blows or like martial art techniques.

2. Description of the Related Art

The practice and performance of martial arts has enjoyed increasing popularity not only in its one or more countries of origin but in the United States as well as other locations throughout the world. While frequently considered a sport or type of physical exercise, it is well understood that various forms of the martial arts also involve significant mental discipline resulting in an overall physical and emotional well being of a participating individual. Perhaps the most popular categories of the martial arts include Tai Kwon Do, Kung Fu, karate and others. A related sport or like physical discipline may also include kick boxing, which while not strictly recognized as a formal martial arts category, does incorporate various martial art techniques such as kicking, punching, etc. Serious participation in any of the martial arts including, but not limited to those set forth above, involves concentrated practice comprising repetitious performance of various types of martial art techniques of the type set forth above. The ability of participants in the martial arts, including students and instructors alike, to maintain a preferred and rigorous practice schedule typically requires the delivering or performance of such blows in a real life atmosphere.

Clearly a significant factor in the practice of martial arts involves mental discipline. As such, the practice of this aspect of martial art techniques may be performed mentally, at least in part, wherein phantom or at least partially imaginary targets are used in the practice procedures. However, it is equally well recognized that in order to become increasingly proficient and perhaps reach the level of a martial arts master in one or more of the above-noted disciplines, an individual must recreate, as much as possible, real situations where kicks, punches and like blows are actually delivered with force. Therefore, in order to create or accomplish a real life environment of the type generally described above, participants of the martial arts interact with one another at least to the extent of one individual holding or otherwise supporting boards, pads, and other "striking targets". In accordance with these conventional practices, one individual delivers real life blows to the striking targets held or supported by a cooperating individual.

While such techniques are considered at least minimally effective for the continued improvement of various forms of martial arts, certain obvious problems and disadvantages do exist. By way of example, one martial art technique involves one individual delivering an appropriate kick, punch or like blow to a board or other target held by another individual. The purpose is to deliver the blow with sufficient force and accuracy to break the board or otherwise strike the held target at a predetermined location. While effective, such practices are frequently dangerous and oftentimes result in injuries to the individual holding the board or other striking target. In order to overcome problems and disadvantages of the type set forth above, a plurality of conventional "exercise devices" are known and believed to be commercially available. Such devices are structured and utilized in a manner somewhat similar to other known strengthening or exercise machines found in well equipped gymnasiums, exercise rooms and even some home or domestic environments.

The similarity between exercise devices associated with the practice of martial art techniques and strengthening or cardiovascular machines may be all too similar. Such similarity is evident in the fact that a number of conventional martial arts practice devices lack the versatility in terms of effective and adjustable structuring to allow an individual to practice a number of the required techniques in a meaningful manner. Also, unlike conventional exercise or strengthening machines, exercise devices associated with the practice of various forms of martial arts must have a somewhat increased or enhanced structural integrity. This is due because the various martial art techniques primarily, if not exclusively, involve delivery of extremely high force kicks, punches, blows, etc.

Accordingly, there is a need in this area for an assembly structured to facilitate the practice of various martial art techniques including, but not necessarily limited to, the performance of various types of kicks, punches, blows, etc. As such, a proposed practice assembly should be able to efficiently and preferably adjustably position at least one, but more practically, a plurality of "striking targets". Such striking targets could include, but are not intended to be limited to, padded structures such as those conventionally known in the martial arts field as "Thai pads". In addition, a proposed practice assembly would have structural and operative features which would allow the adjustable and accurate disposition of the one or more striking targets in an exposed, accessible location to facilitate the real life practicing of the various martial art techniques associated with one or more forms of martial arts. Further, a proposed martial arts practicing assembly could be structured to duplicate, as much as practical, real life positions and orientations, where selective blows are delivered to individual and appropriate ones of the striking targets. As such, the proposed practice assembly would efficiently and effectively position individual ones of the striking targets in a variety of different angular orientations, such that the practiced techniques would closely resemble real life situations.

Also, a proposed and preferred practice assembly should be sufficiently lightweight to be transported to and used in a variety of appropriate locations. Finally, practice assemblies of the type proposed should demonstrate sufficient structural integrity to absorb forces delivered by an individual during a practice session, where numerous martial art blows are delivered to various ones of the aforementioned striking targets in a repetitive fashion.

SUMMARY OF THE INVENTION

The present invention is directed to a practice assembly structured to facilitate the practice of various kicks, punches, blows or like martial art techniques through the support and adjustable positioning of at least one, but more practically, a plurality of "striking targets." While the structural and operational details of the practice assembly of the present invention will be primarily described for use in the attachment, support and positioning of striking targets in the form of "Thai pads", other types of targets can also be utilized. By way of example, at least one embodiment of the present invention includes the support of a punching bag or "speed bag". While a striking target of this type may be more commonly associated with the sport of boxing, it may also be beneficial in the practicing of various martial arts techniques.

As is known in the martial arts field, targets such as Thai pads provide a cushioned or padded structure intended to absorb the force form various blows. Conventionally, such pads are held or supported by one individual, while another individual delivers various types of blows to the pad being held. While the use of Thai pads or other striking targets in this manner are functional and operative for their intended purpose, it is believed that a more efficient utilization of such padded structures, or other striking targets, could be accomplished by the one or more preferred embodiments of the practice assembly of the present invention.

More specifically, the assembly of the present invention comprises at least one elongated stanchion or similar post-like structure operatively disposed in a freestanding and/or upright, operative, substantially vertical orientation when in use. A base is integrally, fixedly or removably connected to a lower end of the stanchion and is structured to provide stable support thereof when the base is positioned on any of a variety of different supporting surfaces. As will be apparent, utilization of the one or more preferred embodiments of the practice assembly of the present invention involves the selective positioning and support of a plurality of striking targets, of the type generally described above. As such, the stanchion, as well as other components associated therewith, should have sufficient stability, strength and overall structural integrity to absorb the force of repeated blows of the type involved in the practice of various martial art techniques. Therefore, the base includes structural features which facilitate the stable support of the stanchion and the one or more striking targets supported thereon. More specifically, the base is structured to include a securing assembly disposed and configured to support or otherwise be connected to a stabilizing assembly.

In yet another preferred embodiment to be described in greater detail hereinafter, the base is structured to include at least two stanchions each being oppositely or otherwise cooperatively disposed relative to one another, to the extent that different individuals may practice on the striking targets associated with different ones of the two stanchions, without interfering with one another. It should be apparent that when utilizing more than one stanchion, wherein concurrent practicing is being conducted on each stanchion, the base supporting the stanchions must demonstrate a sufficient and possibly increased amount of stability. This embodiment of the base is further structurally modified such that each of the two stanchions supported thereon maybe integrally, fixedly or removably connected in their respective operative, substantially vertically upright positions.

Accordingly, the base may include a variety of different structural modifications each of which are adaptable for use with one or more stanchions and one or more different stabilizing assemblies. However, one preferred embodiment of the present invention comprises the base including a stabilizing assembly at least partially defined by one or more securing members attached to each of a plurality of support legs which collectively define the base. Each of the securing members are disposed, dimensioned and configured to receive one or more weight members thereon. As such, a sufficient amount of weight is removably applied to the base to accomplish the desired degree of stability of the one or more stanchions as the striking targets supported thereby absorb the forces from the various techniques practiced on the assembly. Structural details of the one or more weight members may vary significantly from customized weights to conventional weights of the type associated with barbell devices. Therefore in this embodiment of the present invention, such barbell type weight structures may not necessarily be considered an integrated part of the most preferred embodiment of the practice assembly of the present invention, but rather an auxiliary component to be used or otherwise associated therewith.

Yet another preferred embodiment of the present invention comprises the stabilizing assembly structured to include a "variable weight" and being dimensioned and configured to be removably connected to, supported on and at least partially retained by the base of the practice assembly. More specifically, this preferred embodiment of the stabilizing assembly differs from other stabilizing assemblies, as described above, by comprising at least one container structured to hold or contain fluid, such as water or other liquids therein. The variable weight aspect of this embodiment of the stabilizing assembly is such that varying amounts of water or other liquid may be added to the chamber or interior of the one or more containers of this stabilizing assembly. As such, the weight thereof may vary depending upon the quantity of water added. Also, this stabilizing assembly is removable from the base, when the one or more containers are completely or sufficiently empty to significantly lessen the weight thereof, such that the stabilizing assembly as well as other components of the practice assembly may be more easily transported or stored. As generally set forth above, this embodiment of the stabilizing assembly includes one or more containers each representing a stabilizing structure. As such, the stabilizing structures defined by each of the fluid holding containers is distinguishable from the customized or conventional weights of the type associated with barbell devices which may be associated with the stabilizing assembly as described above. More specifically, the individual stabilizing structures which may be defined by a barbell type of weight such that the weight of this type of stabilizing structure cannot normally be varied. It is of course recognized that the stabilizing assembly comprising a plurality of weights can itself be varied by adding or removing individual ones of the weights. However the barbell weights themselves cannot normally be varied. Therefore, the utilization of a stabilizing structure in the form of a fluid holding container, wherein the weight thereof can be selectively varied, by adding or removing fluid, is clearly distinguishable from a barbell or other type weight device.

Additional structural and operative features of the assembly include at least one but more practically a plurality of support assemblies each of which includes at least one elongated support arm. An inner or proximal end of each of the support arms is adjustably connected to the stanchion and includes a sufficient connecting apparatus, such as a spring loaded or other structured quick connect/disconnect device to adjustably attach the support arms at various positions along the length of the stanchion. Accordingly, the support arms may be disposed at substantially any preferred height relative to the supporting surface on which the stanchion is positioned.

In at least one preferred embodiment of the one or more support assemblies, the outer or distal end of each of the support arms is fixedly secured to a mounting structure. The mounting structure is dimensioned and configured to facilitate a supportive interconnection with at least one or a plurality of different striking targets. As set forth above, one striking target of the type intended to be used with at least one preferred embodiment of the present invention is a Thai pad. As such, the one or more mounting structures include a sufficient dimension and/or configuration to securely, but preferably removably, mount the Thai pad or like striking target on the mounting structure. In addition, individual ones of the mounting structures associated with different ones of the support arms are preferably disposed at a predetermined orientation as relates to the substantially upright and/or vertical orientation of the stanchion. Accordingly, the various orientations of the mounting structures, as well as the striking targets mounted thereon, are such as to best facilitate the practice or exercise of various types of kicks, punches, blows or like martial art techniques to which individual ones of the striking targets may be subjected. Accordingly, the selective and preferred positioning of a plurality of striking targets at exposed, accessible locations and at preferred orientations provides an efficient and effective martial arts practice assembly. Further, such a preferred assembly overcomes many of the disadvantages and problems recognized with conventional devices, structures and related assemblies associated with the practicing of martial arts techniques and/or the procedures associated therewith.

Yet another preferred embodiment comprises a structural modification of one or more of the support assemblies and the corresponding mounting structures associated therewith. More specifically, a mounting structure may be movably connected to the outer or distal end of the support arm with which it is associated. Further, a force absorbing assembly is associated with the interconnected support arm and mounting structure to the extent that any force or blow delivered to the striking target secured to the mounting structure will be at least partially, but effectively, "absorbed" by the force absorbing assembly. This of course differs from others of the preferred embodiments described above wherein the one or more mounting structures were integrally or otherwise fixedly connected to the outer end of the corresponding support arm(s). Such a fixed connection resulted in any force being delivered to the striking pad being "absorbed" by the padding or cushioning material from which the striking target is formed, rather than the static, fixedly connected support arm and mounting structure.

The versatility of the practice assembly of the present assembly is further demonstrated by including a support assembly and corresponding mounting structure cooperatively structured to support a striking target in the form of the aforementioned punching bag. As will be further described, this embodiment of the present invention includes additional structure which facilitates the movable connection of the punching bag or "speed bag" to the support assembly and corresponding mounting structure such that the punching bag depends or hangs downwardly from the mounting structure, so as to be usable in an intended fashion.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

In accordance with the accompanying Figures, the present invention is directed to a practice assembly generally indicated as 10 specifically, but not exclusively, intended for the practice of various martial art techniques such as kicks, punches and like blows. More specifically, the assembly 10 includes an elongated stanchion 12 formed of a high strength, rigid material. Because of its intended use, the material from which the stanchion 12 is formed, along with the other structural and operative components of the present invention, must demonstrate sufficient strength and overall structural integrity to withstand the forces of various, repetitive blows or other martial art techniques practiced on the assembly 10.

Figures 1, 1A:
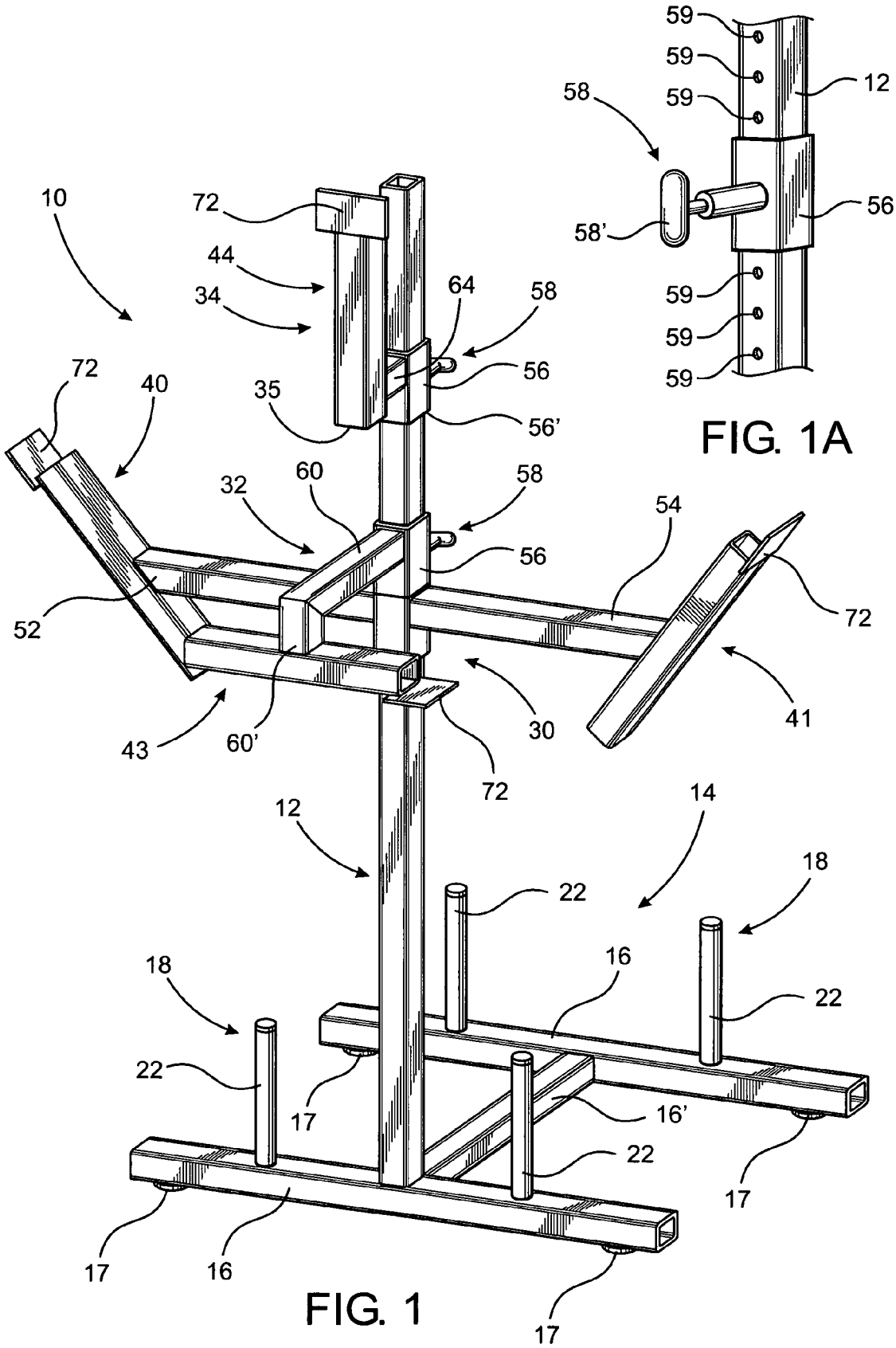
FIG. 1 is a perspective view of a preferred embodiment of the martial arts practice assembly of the present invention in an assembled form absent normally accompanying auxiliary components, including striking targets and a stabilizing assembly as represented FIG. 2.
FIG. 1A is a rear perspective view in partial cutaway of a portion of the practice assembly of the preferred embodiment and a quick connect device associated therewith.

Additional stability is provided by the lower end of the stanchion 12 being integrally, fixedly or removably, but securely, connected to a base, generally indicated as 14. A purpose of the base 14 is to support the stanchion 12 and the various structural components associated therewith on any one of a plurality of different supporting surfaces. Further, the base 14 is preferably dimensioned, configured and structured to provide sufficient stability to the assembly 10, such as resisting swiveling, tipping, etc, as the various blows or other martial art techniques are practiced thereon. Therefore, the base 14 comprises a plurality of support legs 16 being relatively disposed and appropriately elongated or otherwise configured to provide the required stability during a practice session. As represented in the FIGS. 1 and 2, the base 14 may assume a variety of configurations and as such the number and relative positions of the legs 16 may differ. One preferred structural configuration of the base is represented in FIG. 1 and includes the two elongated legs 16 interconnected by a brace structure 16'. In contrast, the base of FIG. 2 includes a plurality of preferably three legs 16 each extending substantially radially outward from a lower end of the stanchion 12.

Stability of the base 14 and remaining portions of the assembly are further facilitated by the provision of an adjustment assembly comprising at least one, but more practically, a plurality of adjustment members, represented in FIG. 1, and movably connected to under portions of the different legs 16. Each of the one or more adjustment members may be movably positioned to facilitate a substantial leveling or other preferred or predetermined orientation of the stanchion 12 on a supporting surface, as represented in FIG. 1. Also, the base structures 14 of both FIGS. 1 and 2 include a securing assembly, generally indicated as 18, which is disposed, dimensioned and configured to connect or otherwise support a stabilizing assembly 20, represented in the accompanying Figures.

In order to accommodate the stabilizing assembly 20 one preferred embodiment of the practice assembly 10 comprises the securing assembly 18 including at least one but more practically a plurality of securing members 22 in the form of elongated rods or posts. Each of the one or more rods 22 is secured to and extends upwardly or outwardly from a correspondingly disposed support leg 16. Further, the dimension of each of the rods 22 is such as to removably engage or be connected in retaining relation to at least one weight structure or other stabilizing structure 24. As such, the one or more weight structures or other stabilizing structures 24 define the aforementioned stabilizing assembly 20. Further, the one or more weight structures 24 may be conventionally structured weight members of the type associated with barbell devices. Alternatively the stabilizing structures may be may be customized or otherwise structured, as will be explained in greater detail with reference to the embodiment of FIG. 12, for use with the base 14. Accordingly, in at least one preferred embodiment of the present invention the stabilizing assembly 20 comprising one or more substantially conventional "barbell" type weight members 24, are not considered a part of the present invention.

Figure 12:
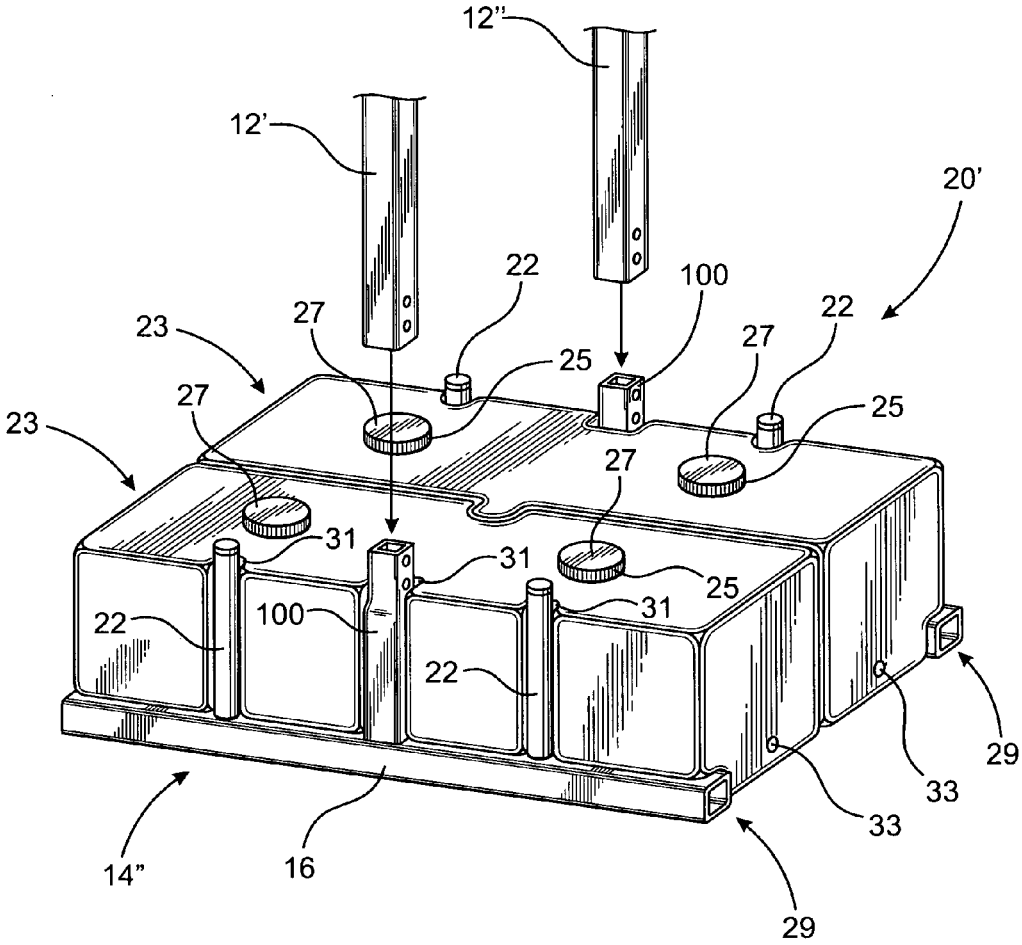
FIG. 12 is a perspective view in partial cutaway and exploded form of an additional preferred embodiment of the present invention directed to a base and a stabilizing assembly associated therewith.

It is emphasized that weight structures or members 24 of various types may define the stabilizing assembly 20 and be adapted for use with the securing assembly 18. As should be apparent, the support members 22 could be correspondingly adapted in terms of structure, dimension and configuration to support or otherwise connect various other types of stabilizing structures 24 to the base 14. Accordingly, one additional preferred embodiment of the present invention is represented in FIG. 12, wherein the base 14" includes securement members in the form of rods or bars 22 similar to the previously described embodiments. However the stabilizing assembly, generally indicated as 20' comprises one or more stabilizing structures in the form of containers 23. Each container 23 includes an interior chamber (not shown for purposes of clarity) and an access opening 25 which may be covered by a cap or like closure 27. One or more access openings 25 associated with each of the containers 23 allows the filling of the interior chambers of each container 23 with a fluid such as, but not limited to a liquid, including water. Clearly the size of the individual containers 23, as well as the volume represented by there interior chambers is such as to hold varying quantities of liquid on the interior thereof. Therefore, the stabilizing assembly 20' may be accurately described as having a "variable weight". Such a variable weight is defined by the quantity of water or other fluid, in the form of liquid, selectively placed on the interior of the respective containers. Obviously, a greater quantity of fluid added to the interior chamber of each of the one or more containers 23 increases the weight thereof and provides additional stability to the base 14" as well as the stanchions 12' and 12", which may be removably connected to the base 14" as explained in detail with regard to the embodiment of FIGS. 7 and 8.

Other features of the one or more containers 23 defining the individual stabilizing structures is their dimension and configuration so as to be at least partially supported on the base 14' as at 29, but be easily removable there from. Further, side portions of the individual containers 23 may include indented or recessed channels 31 disposed, dimensioned and configured to receive the securement members 22 as well as the stanchion mounts 100. It is emphasized that the specific number, dimension, configuration and overall structure of each of the one or more containers 23 may vary significantly so as to be readily adaptable to the structure of different bases 14, 14', 14", etc. Additional structural features of each of the one or more containers 23 includes the provision of a drain structure 33 which facilitates the removal of the fluid from the interior chamber of each of the containers 23, when desired. Accordingly, the fluid may be removed by applying a pumping or siphoning action, gravity flow or any other appropriate means of removing the fluid from the interior chamber of the one or more containers 23. Clearly, when the fluid is so removed, the weight of the stabilizing assembly 20' can be significantly lessened, thereby facilitating the removal of the individual stabilizing structures defined by the one or more containers 23.

Another feature of the present invention is the provision of at least one but more practically a plurality of support assemblies generally indicated as 30, 32 and 34. Each of the support assemblies 30, 32 and 34 are preferably, but not necessarily, formed from a high strength, rigid and preferably non-flexible material, as is the material from which the stanchion 12 is formed. As such, various components of the practice assembly 10 demonstrate sufficient strength and structural integrity to withstand the forces from the blows exerted thereon, as set forth above. Further, each of the support assemblies 30, 32 and 34 include a support arm having a proximal end interconnected to the stanchion 12 and a distal end connected in supporting relation to a different one of a plurality of mounting structures 40, 41, 43 and 44. As will also be explained in greater detail hereinafter, each of the mounting structures 40 through 44 comprise an appropriate dimension, configuration and overall structure to support at least one type of striking target 50 thereon. As set forth above, a most preferred striking target to be used in combination with the assembly 10 comprises a pad or like cushioned device, conventionally known in the martial arts area as a "Thai pad". However, as demonstrated in an additional preferred embodiment of FIGS. 9 through 11, other types of striking targets, such as a punching bag and/or speed bag may be included for use with the exercise assembly of the present invention. Accordingly, striking targets of types other than Thai pads, punching bags, etc, may or may not include a padded or cushioned structure and still may be used with the assembly 10. Therefore, structural modifications to the mounting structures 40 through 44 in order to adapt to at least some different types of striking targets may be minimal or nonexistent.

As demonstrated in the embodiments of FIGS. 1 through 5, each support assembly 30, 32 and 34 preferably includes at least one elongated arm 52, 54, 60 and 64 extending transversely outward from the stanchion 12 in various predetermined and preferably different directions. In addition, the inner or proximal end of each of these support arms is associated with a mounting or connecting collar generally indicated as 56. Each of the collars 56 is dimensioned and configured to be movably and/or adjustably connected to the stanchion 12 by placement in substantially surrounding relation thereto as clearly demonstrated. In addition, at least one connector 58 is mounted on or otherwise associated with each collar 56 so as to quickly and easily connect or disconnect the collar 56, as well as the corresponding support arm, relative to the stanchion 12.

With primary reference to FIG. 1A, each of the connectors 58 may include a spring biased structure associated with a connecting pin (not shown for purposes of clarity) dimensioned to fit within any of the plurality of holes or apertures 59 extending in spaced relation to one another along the length of the stanchion. An outward pulling force exerted on the pull handle or knob 58' will serve to remove the associated connecting pin from a corresponding one of the holes 59, thereby detaching the collar 56 from the stanchion 12. Reconnecting the collar 56 involves a reverse procedure, including a release of the handle when the connecting pin is aligned with an appropriate aperture. This results in a passage of the pin into the aperture due to a biasing force exerted on the connecting pin by the aforementioned spring biased structure. Therefore, each of the support arms and their associated support assemblies 30, 32 and 34 may be selectively disposed at any of a plurality of preferred locations along the length of the stanchion 12. As such, the height of the support assemblies 30, 32 and 34, relative to the supporting surface of the stanchion, may be adjusted so as to properly position the corresponding striking targets 50 at a location which best facilitates the performance of intended kicks, such as side kicks, or other martial art techniques.

Figure 3:
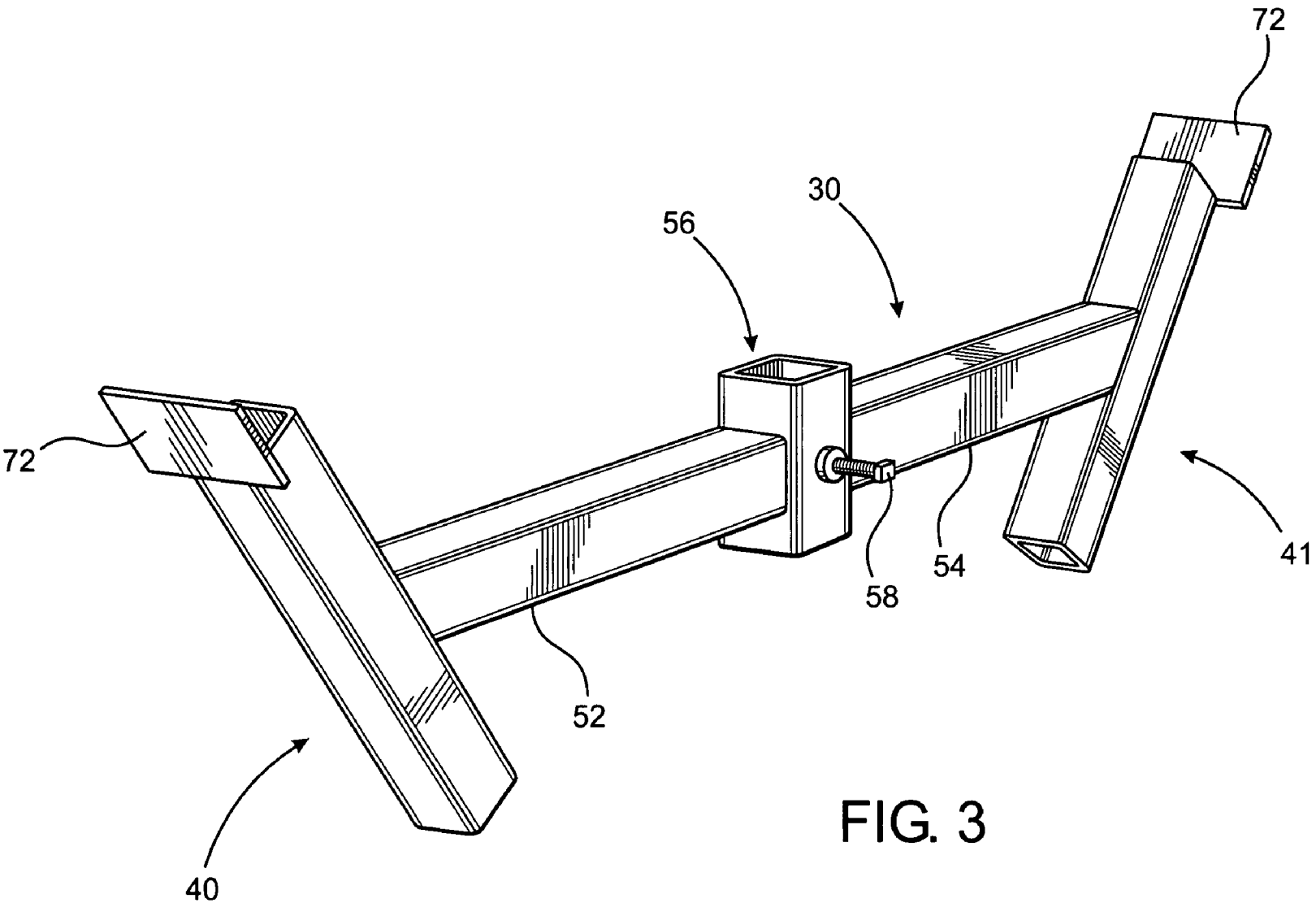
FIG. 3 is a perspective view in detail of one embodiment of a support assembly associated with the preferred embodiment of FIGS. 1 and 2.
Figure 4:
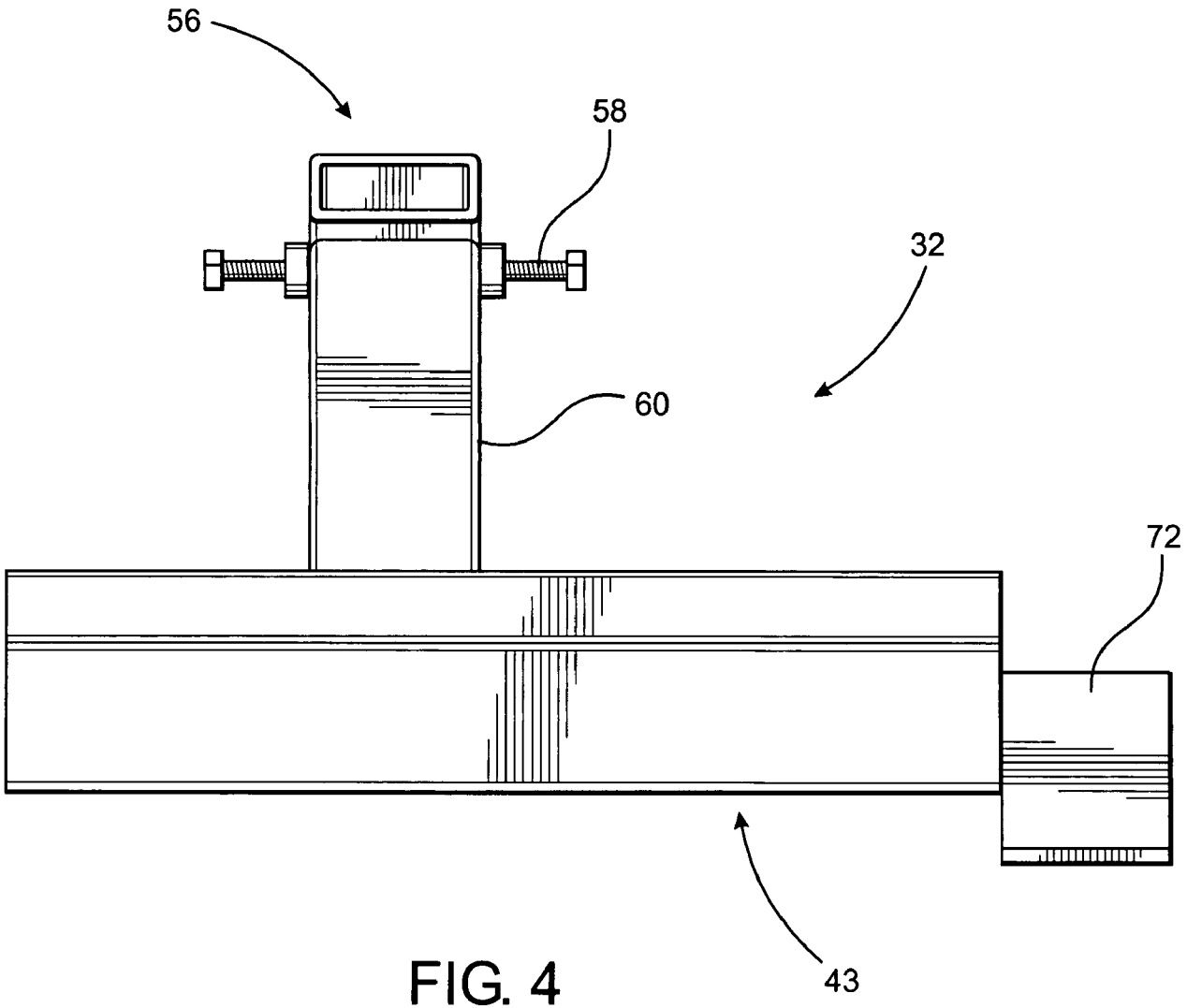
FIG. 4 is a perspective view in detail of yet another embodiment of a support assembly associated with the preferred embodiment of FIGS. 1 and 2.
Figure 5:
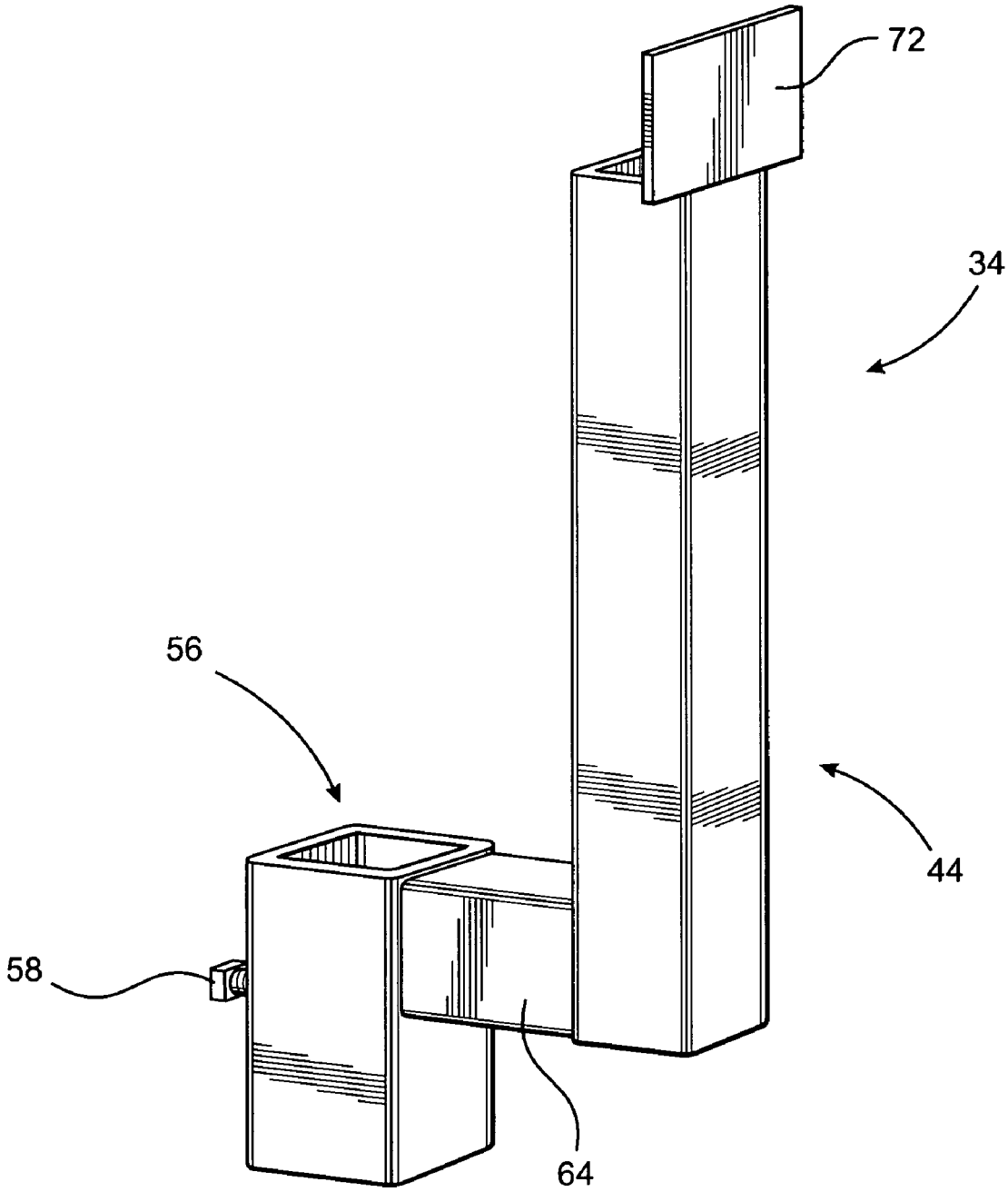
FIG. 5 is yet another embodiment of a support assembly associated with the preferred embodiment of FIGS. 1 and 2.

As represented in FIG. 3 the support assembly 30 includes twin support arms 52 and 54 each having a different one of the mounting structures 40 and 41 fixedly, integrally or otherwise connected to an outer or distal end thereof. As will be explained with primary reference to different structural embodiments of the support assemblies 30, 32 and 34, as represented in FIGS. 3 through 5, the structural features may vary while the intended operative purpose of each of the support assemblies 30, 32 and 34 are substantially similar. With further reference to FIG. 3, it is noted that each of the mounting structures 40 and 41 comprise a substantially elongated configuration secured to the distal ends of the arms 52 and 54 respectively at a predetermined angular orientation relative to the upright, substantially vertical orientation of the stanchion 12. In doing so, the angular orientation of the mounting structures 40 and 41 determine the corresponding attitude or angular orientation of the corresponding striking targets 50 thereby further facilitating the efficient practice or performance of sidekicks or other martial art techniques practiced thereon.

With primary reference to FIG. 4, the support assembly 32 includes an elongated arm 60 having its distal end fixedly, integrally or otherwise connected to the mounting structure 43. The opposite or inner, proximal end of the support arm 60 is secured to the mounting or connecting collar 56 as represented in detail in FIG. 1A. Also, one or more connecting structures 58 are connected to or otherwise associated with the collar 56 for purposes of adjustably securing the support assembly 32 and the corresponding mounting structure 43 along the length of the stanchion 12. The support assembly 32 and the mounting structure 43 may be removably and/or adjustably disposed at any preferred or predetermined height relative to the supporting surface on which the assembly 10 is positioned. A preferred structural variation of the embodiment of FIG. 4 is represented in FIG. 1, wherein the support arm further includes a spacer arm or like structure 60' secured to the outer extremity thereof. The spacer arm 60' is disposed, dimensioned and configured provide a predetermined spacing between the mounting structure 43 and the support arm 60, thereby reducing the possibility of a user's foot accidentally engaging the support arm 60 instead of the intended striking target 50.

With primary reference to FIG. 5, one embodiment of the support assembly 34 includes an at least minimally elongated support arm 64 having its outer or distal end secured to mounting structure 44 and its inner end secured to mounting or connecting collar 56. The collar 56 and the connecting device 58 have the structural and operative features described with relation to the embodiment of FIG. 1A. One or more connecting devices 58 and 58' are associated with the collar 56 so as to adjustably dispose and connect the support assembly 34 and its associated mounting structure 44 at various locations along the length of the stanchion 12 and at various heights relative to the supporting surface on which the assembly 10 is positioned. It is of course noted that the support arm 64 has a significantly less longitudinal dimension than the support arms 52, 54 and 60 associated with the support assemblies 30 and 32 of the embodiments of FIGS. 3 and 4. However, the support arm 64 is considered to be at least minimally elongated to the extent of positioning the mounting structure 44 in a preferred, transversely outward position relative to the stanchion 12 as clearly demonstrated in FIGS. 1 and 2.

A preferred structural modification of the mounting structure 34, as represented in FIG. 5, is represented in FIG. 1. More specifically, the support arm 64, the collar 56 and the mounting structure 34 are cooperatively disposed, dimensioned and configured to position the lower most end 35 of the mounting structure 34 beneath or substantially level with the corresponding end 56'. This will reduce the possibility of a portion of the user's body inadvertently coming in contact with the collar 56 or adjacent structure, rather than a corresponding striking target 50 mounted on the mounting structure 44.

Figure 2:
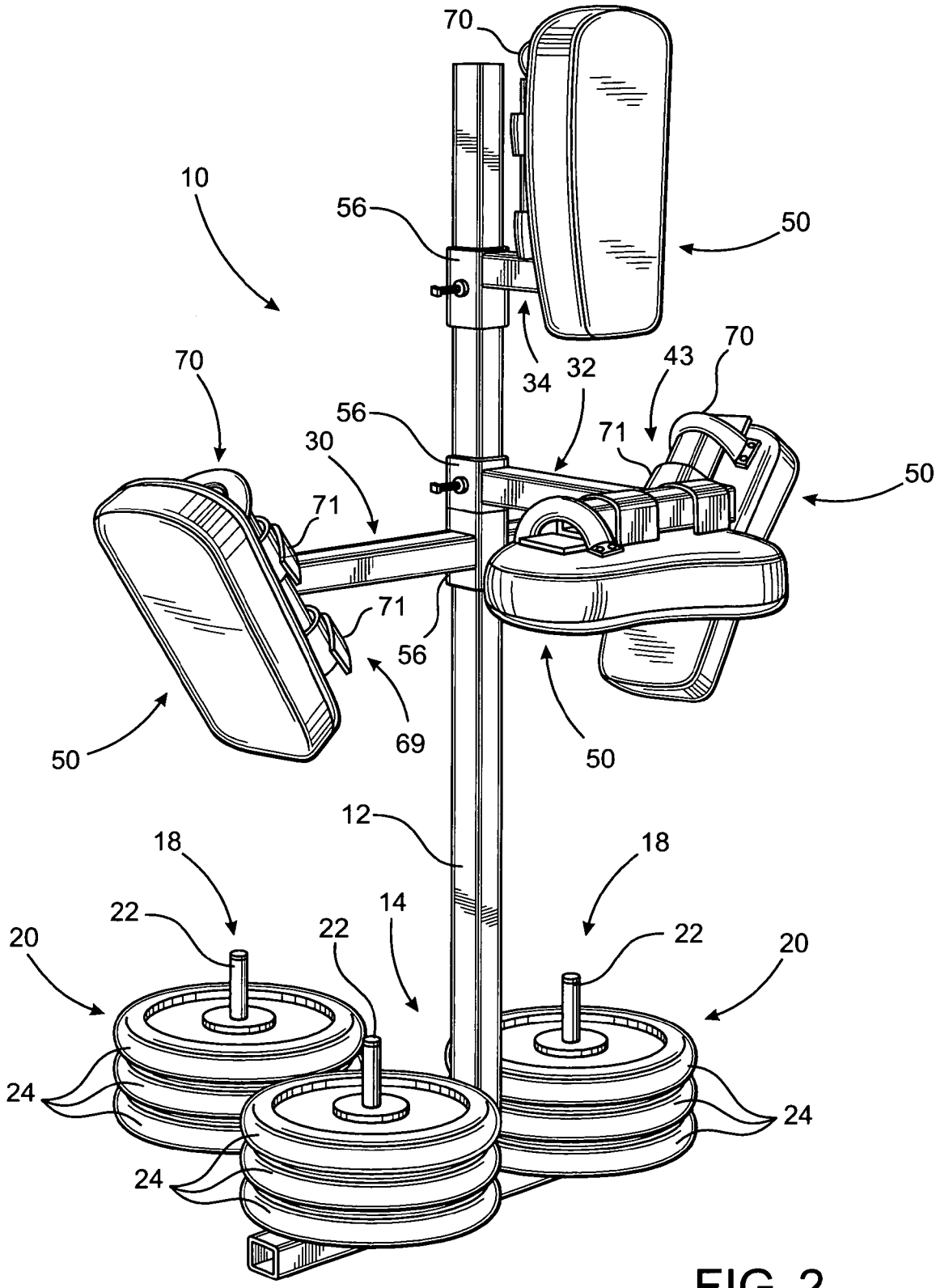
FIG. 2 is a perspective view of the martial arts practice assembly of the present invention in an assembled form and in an operative position with various auxiliary components mounted thereon.

The support assemblies 30, 32 and 34 and their respective mounting structures 40 through 44 have been described for use with the most preferred embodiments of the assembly 10 as represented in FIGS. 1 and 2. However, it should be noted that other and/or additional support assemblies may be utilized. If other and differently structured support assemblies are used with the practice assembly 10, the overall dimension and configuration thereof may differ in order to support additional striking targets or Thai pads 50 in different orientations or positions so as to further facilitate the practice of martial art techniques as should be apparent. Also, depending upon the intended location and preferred orientation of each of the plurality of striking targets 50 their specific angular orientation relative to the upright, free standing stanchion 12 is purposely varied or pre-selected in order to facilitate the practice or performance of various kicks, punches, blows or other martial art techniques as also should be apparent.

By way of example, the support assembly 30 includes twin support arms 52 and 54 sharing a common mounting or connecting collar at their innermost, correspondingly positioned ends. Also, the mounting structures 40 and 42 are angularly oriented in a skewed or other appropriate angle relative to the substantially vertical axis of the stanchion 12 in order to practice or perform sidekicks or other techniques. In contrast, the support assembly 32 extends transversely and/or radially outward from the stanchion 12 and has its mounting structure 43 oriented in substantially perpendicular relation to the axis 12. Therefore, the Thai pad or like striking target 50 assumes the same perpendicular attitude. As such, the Thai pad associated with the support assembly 32 and the mounting structure 43 facilitates the practice of utilizing an individual's knee to deliver blows to the striking target 50. In further contrast, the support assembly 34 includes the mounting structure 44 arranged in substantially parallel orientation to the length or longitudinal axis of the stanchion 12 in order to deliver various types of punches, kicks or like blows associated with martial art techniques.

As set forth above, the dimension, configuration and overall structure of each of the mounting structures 40 through 44 are such as to be adapted for the removable support of striking targets 50 preferably, but not exclusively, in the form of Thai pads. As such, each of the Thai pads conventionally comprises an attachment assembly 69 including a grip or handle structure 70 and one or more straps, belts, etc. 71 as represented in FIG. 2. Further, each of the handle structures 70 are typically structured to assume a closed loop-type configuration. As such, the handle or grip structure 70 is sufficiently dimensioned and configured to fit over and at least partially surround an appropriately disposed, dimensioned and configured adaptor member 72 associated with each or one or more of the mounting structures 40 through 44. Removable connection of each of the Thai pads or like striking targets 50 may be further accomplished by the belts, straps or other harness structures 71 of the attachment assembly 69 being disposed in surrounding relation to various portions of the elongated mounting structures 40 through 44 as also represented in FIG. 2.

Figure 13:
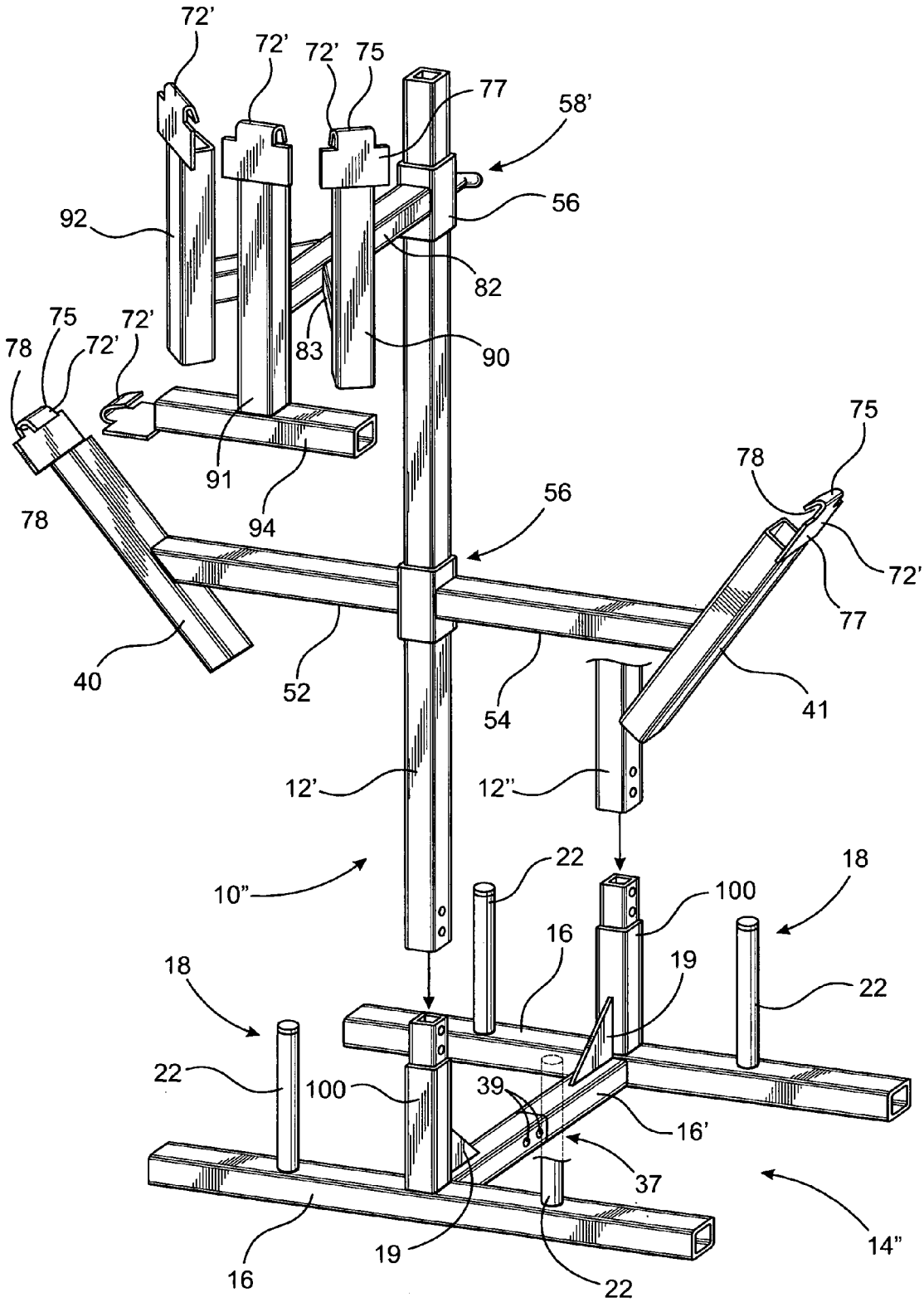
FIG. 13 is a perspective view of yet another preferred embodiment of the practice assembly of the present invention in partial cutaway and exploded form similar to but distinguishable from the embodiment of FIG. 6.
Figure 13A:
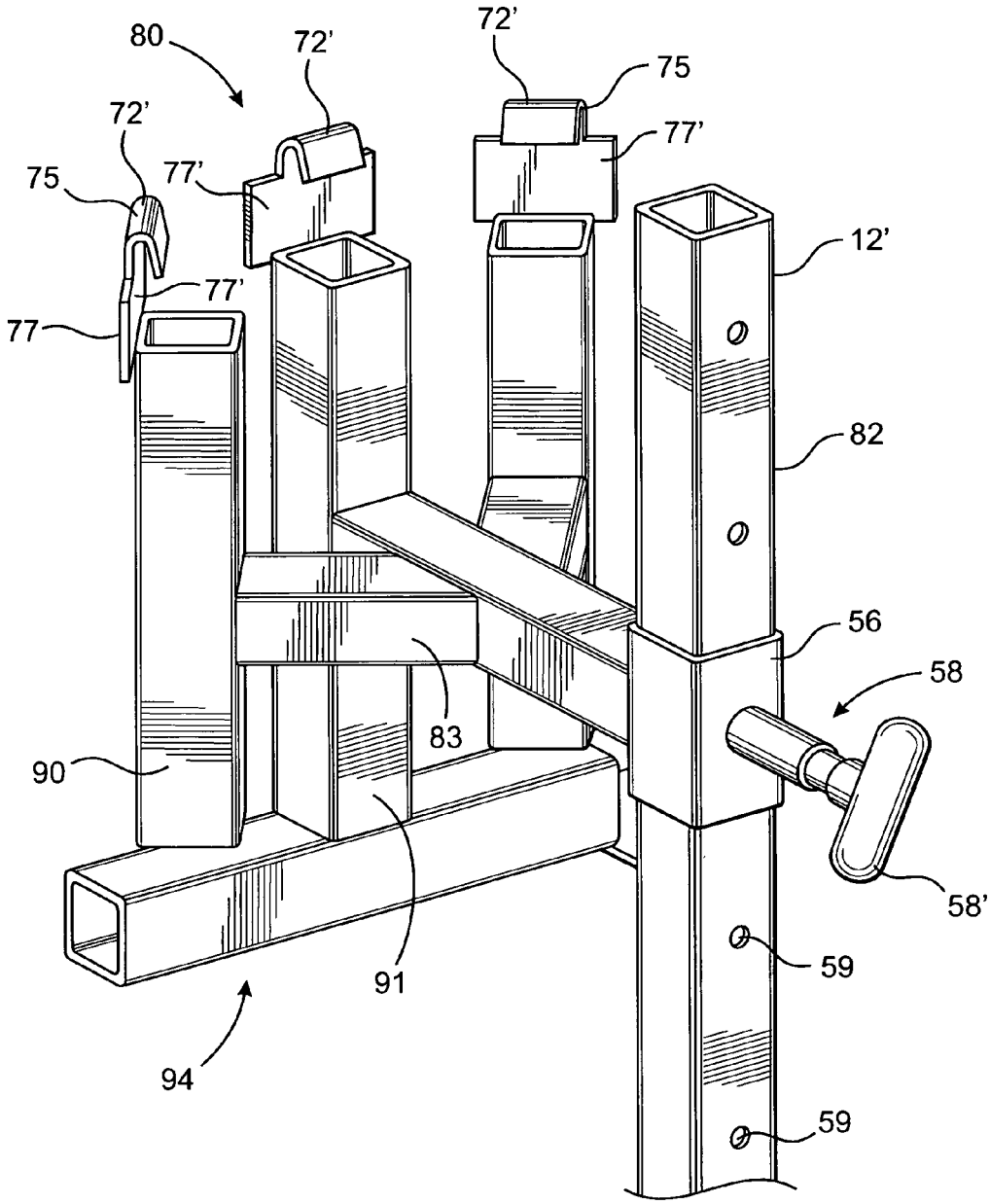
FIG. 13A is a rear perspective view in partial cutaway of a portion of the practice assembly of the preferred embodiment of FIG. 13.

Yet another preferred embodiment of the present invention is represented in FIGS. 13 and 13A. As should be apparent, the practice assembly 10" represented therein is similar in structure and performance to the practice assembly 10' represented in FIG. 6. However certain structural differences are present including the structuring of the base 14" thereof. More specifically, the base 14" includes outwardly extending legs 16 interconnected by a brace segment 16'. However the brace segment 16' is separable as at 37. Also, the separable portions of the base 14" are each structured to support different stanchions, as at 12' and 12". As with the embodiments of FIGS. 7 and 8, each of the stanchions 12' and 12" can be removably connected to the base 14" by virtue of the stanchion mounts 100. Alternatively, each or different ones of the stanchions 12' and 12" can be fixedly attached to the base 14" as represented in the embodiments of the practice assembly 10 and 10' of FIGS. 1 and 6 respectively. Accordingly, the separable portions of the base 14" are interconnected by the separable brace segment 16' as at 37. Fixed but removable interconnection of the brace segment 16' may be accomplished by the use of locking pins, cotter pins or other appropriate structures passing through aligned apertures as at 39. Other forms of removable connection may be applied to the separable portion 37 of the brace segment 16' in order to facilitate the selective attachment or detachment of the separable portions of the base 14" from one another.

Additional structural features associated with the embodiment of the practice assembly 10" as represented in FIGS. 13 and 13A include the use of adaptor members 72' connected to some or all of the respective mounting structures represented in the embodiments of FIGS. 6, 6A, 13, and 13A. A structural modification representing an additional preferred embodiment of the adaptor members 72' includes a hook shaped portion 75 connected to and extending axially outwardly from a substantially planar segment or plate 77 associated with each of the adaptor members 72'. Therefore, the hook shaped portion 75 of each of the adaptor members 72' is disposed and configured to extend somewhat outwardly from an inner surface or face 77' of the planar or plate segment 77 of the same adaptor member 72'. More specifically, in the embodiment of FIGS. 13 and 13A, each of the adapter members 72' includes the hook shaped portion 75 disposed on an outer most end thereof and extending axially outward therefrom. In addition, each of the hook shaped portions 75 may be more specifically defined by a curved flange extending outwardly from the rear face or surface 77' of corresponding ones of the adapter members 72'. As such, the hook shaped portions and/or inwardly curved flanges 75 include an interior retention area 78 as represented in FIG. 13. The interior retention area 78 is disposed, dimensioned and configured to at least partially surround and removably receive the end portion or more specifically the handle structure 70 defining a part of the attachment assembly 69 of the striking target 50, as described above with reference to FIG. 2. When the handle structure 70 is disposed in removably receiving relation within the interior retention area 78, outward axial displacement of the striking target 50, away from the corresponding mounting structure and adaptor member 72' is restricted. The striking target(s) 50 is thereby maintained in an appropriate, exposed position even when a significant force is delivered thereto during the practice of martial art techniques.

Accordingly, this configuration of the hook shaped portion or inwardly curved flange 75 facilitates the removable but retaining engagement of the handle structure 70 or other parts of the attachment assembly 69 associated with the striking target 50, especially when the striking target 50 is in the form of a Thai pad, as clearly represented in FIG. 2. However, the hook shaped portion 75 of each of the adaptor members or plates 72' is such as to be readily adaptable for removable, retaining engagement with a variety of other types of padded or non-padded striking targets, other than the Thai pads 50.

Additional preferred embodiments of the practice assembly are represented in detail in FIGS. 6 through 11. With primary reference to FIGS. 6 and 6A, one additional preferred embodiment is generally indicated as 10' and, with certain exceptions, comprises a substantially equivalent structure to the embodiment of the FIG. 12. Moreover, the practice assembly 10' includes an elongated, upstanding stanchion 12 connected to the base 14 by being fixedly or removably attached thereto as described in greater detail with regard to the embodiment of FIGS. 7 and 8. The practice assembly 10' further includes a support assembly 30 including outwardly extending support arms 52 and 54 each connected to a correspondingly positioned mounting structure 40 and 41. It is emphasized that in a comparison between the preferred embodiments of FIGS. 1 and 1A and 6 and 6A, like reference numerals refer to like parts throughout these and other Figures.

Figure 6:
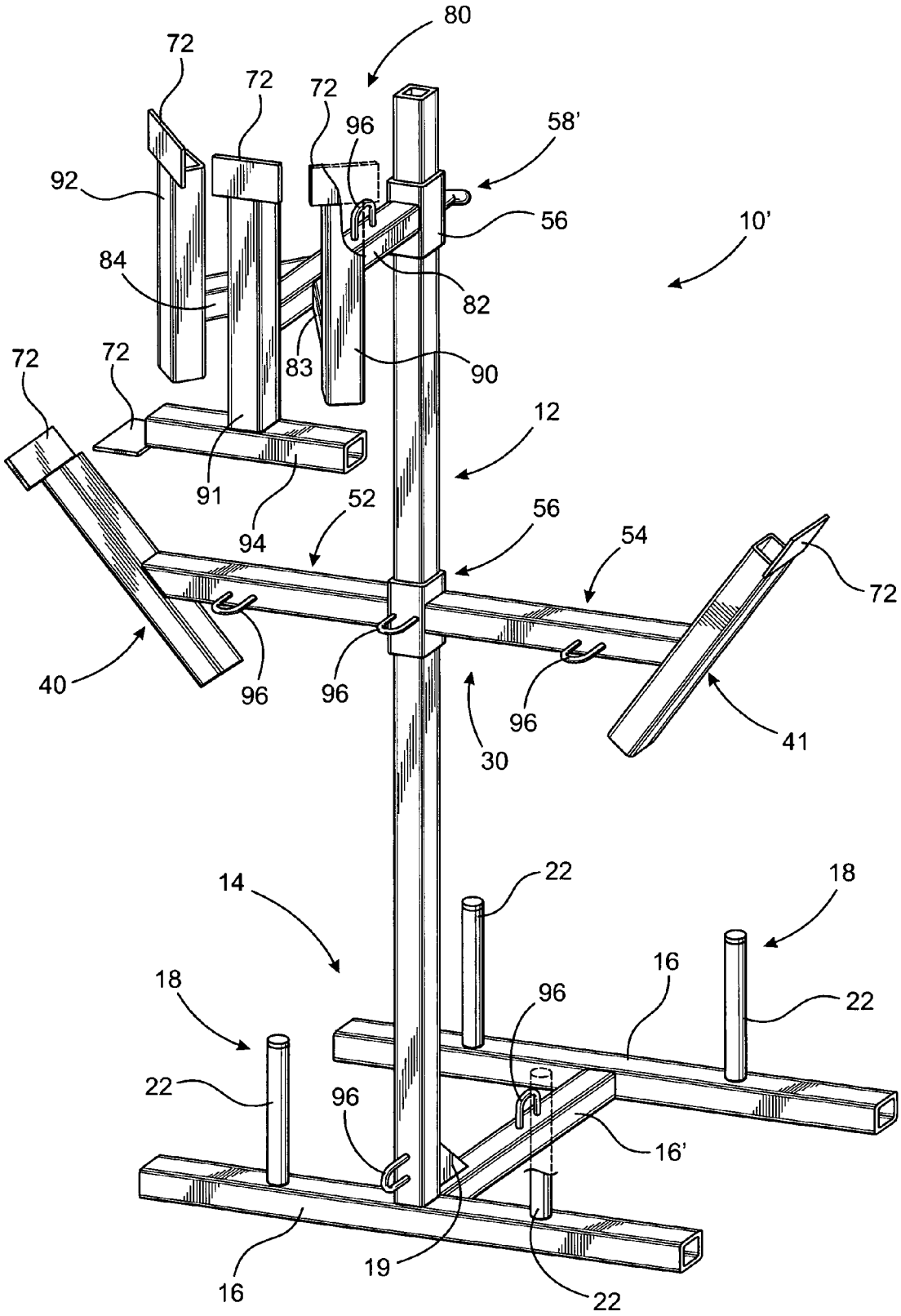
FIG. 6 is a perspective view of yet another preferred embodiment of the practice assembly of the present assembly in an assembled form absent normally accompanying auxiliary components, including the striking targets and a stabilizing assembly of the type disclosed in FIG. 2.
Figure 6A:
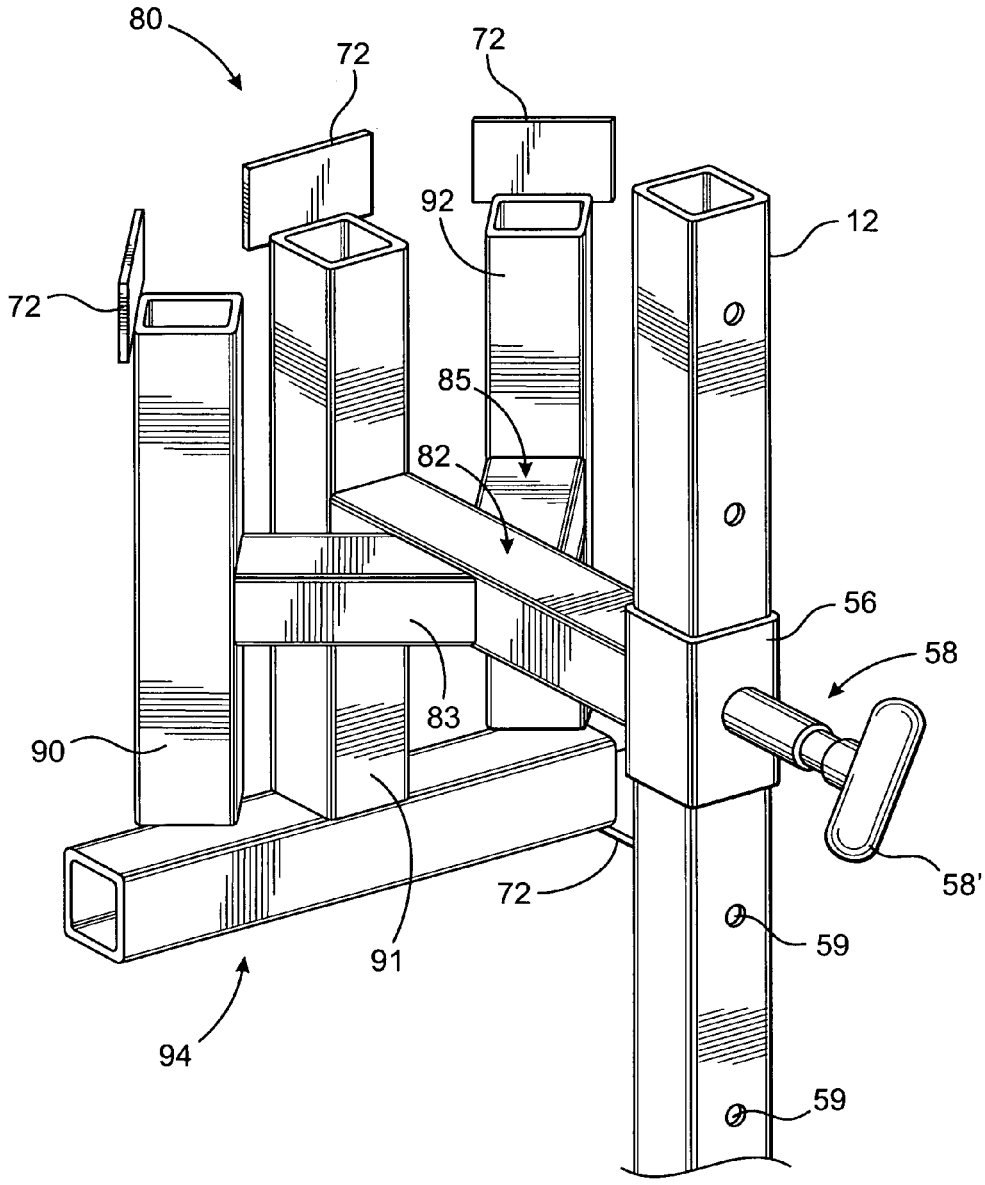
FIG. 6A is a rear perspective view in partial cutaway of a portion of the practice assembly of the preferred embodiment of FIG. 6.

Structural modifications of the practice assembly 10' include what may be generally considered the combining of support assemblies 32 and 34 of the preferred embodiment of FIG. 1 into the support assembly generally indicted as 80 in FIGS. 6 and 6A. More specifically, support assembly 80 includes at least one outwardly extending, elongated support arm 82 having a proximal end connected to the adjustable collar structure 56 which incorporates the spring biased handle or gripping member 58', operative in the manner described above with reference to FIGS. 1 through 5. As clearly represented in FIGS. 6 and 6A the support arm 82 includes a distal end having what may be generally referred to as a "branched" configuration or structure comprising outwardly angled arm segments 83, 84 and 85. As further represented in FIGS. 6 and 6A, the support assembly 80 and in particular the support arm 82 is connected in supporting relation to three spaced apart mounting structures 90, 91 and 92. Each of the mounting structures 90 through 92 are respectively connected to the arm segments 83, 84 and 85. Further, the mounting structures 90, 91 and 92 are disposed in substantially parallel relation to one another, while being further disposed at a predetermined aligned or angular orientation relative to the central longitudinal axis of the support arm 82.

Yet another structural feature of the embodiment in FIGS. 6 and 6A is the provision of a fourth mounting structure 94 connected to one of the three mounting structures 90 through 92, as at 91. As further represented, the mounting structure 94 is connected to a lowermost end of the mounting structure 91 and is disposed in a perpendicular or otherwise transverse orientation to the length of the mounting structure 91. As represented, the fourth mounting structure 94 is located below the array of mounting structures 90 through 92 and depends from at least one of such mounting structures as at 91 and as set forth above. Additional structural features of the mounting structures 90, 91, 92 and 94 include the provision of an adapter plate 72 (see FIGS. 1 through 6) or adapter plate 72' (see FIGS. 13 and 13A) to facilitate the mounting of a Thai pad or other striking target 50, in the manner demonstrated in FIG. 2.

Figure 15:
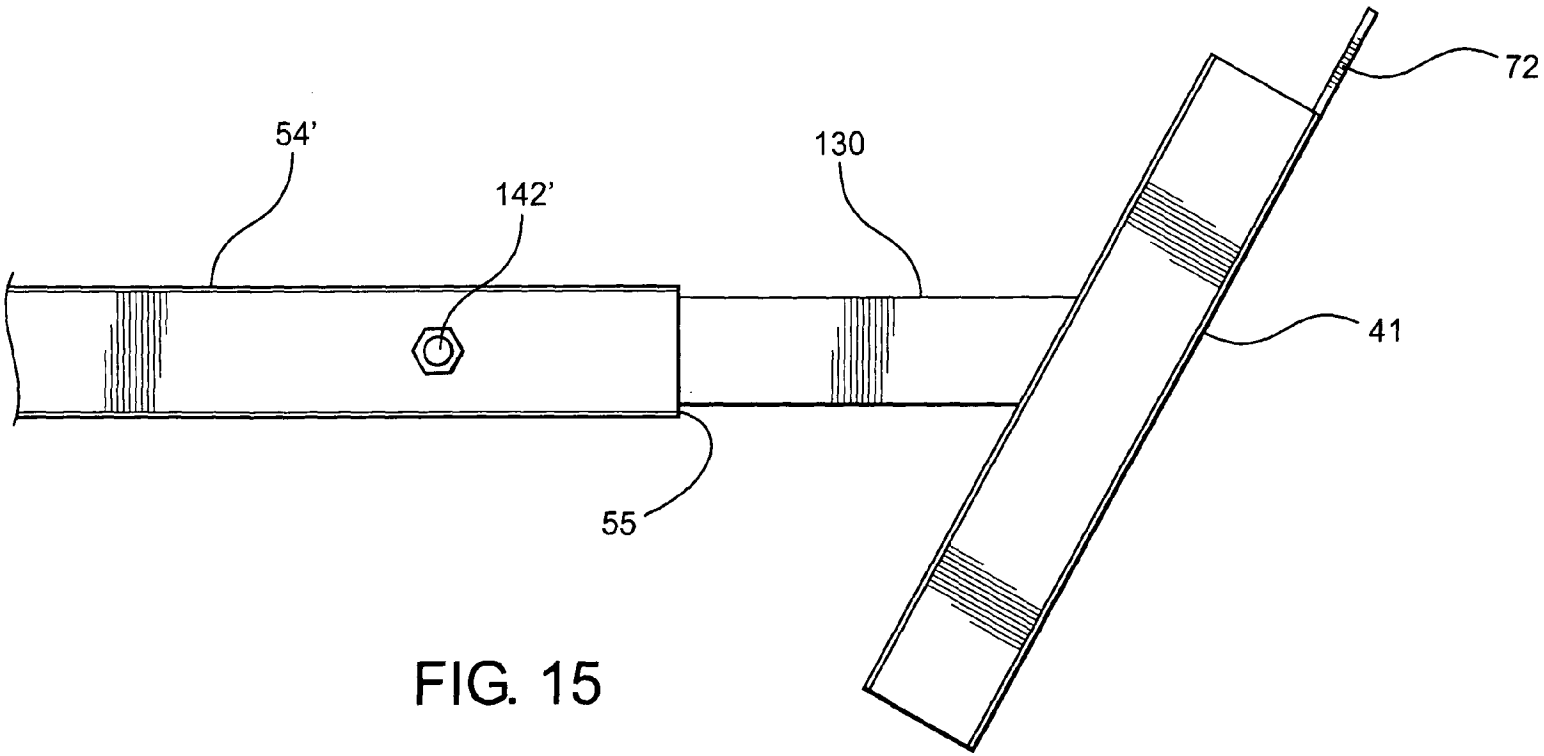
FIG. 15 is a side view in partial cutaway of yet another preferred embodiment of a support assembly and corresponding mounting structure represented in an extended position.
Figure 16:
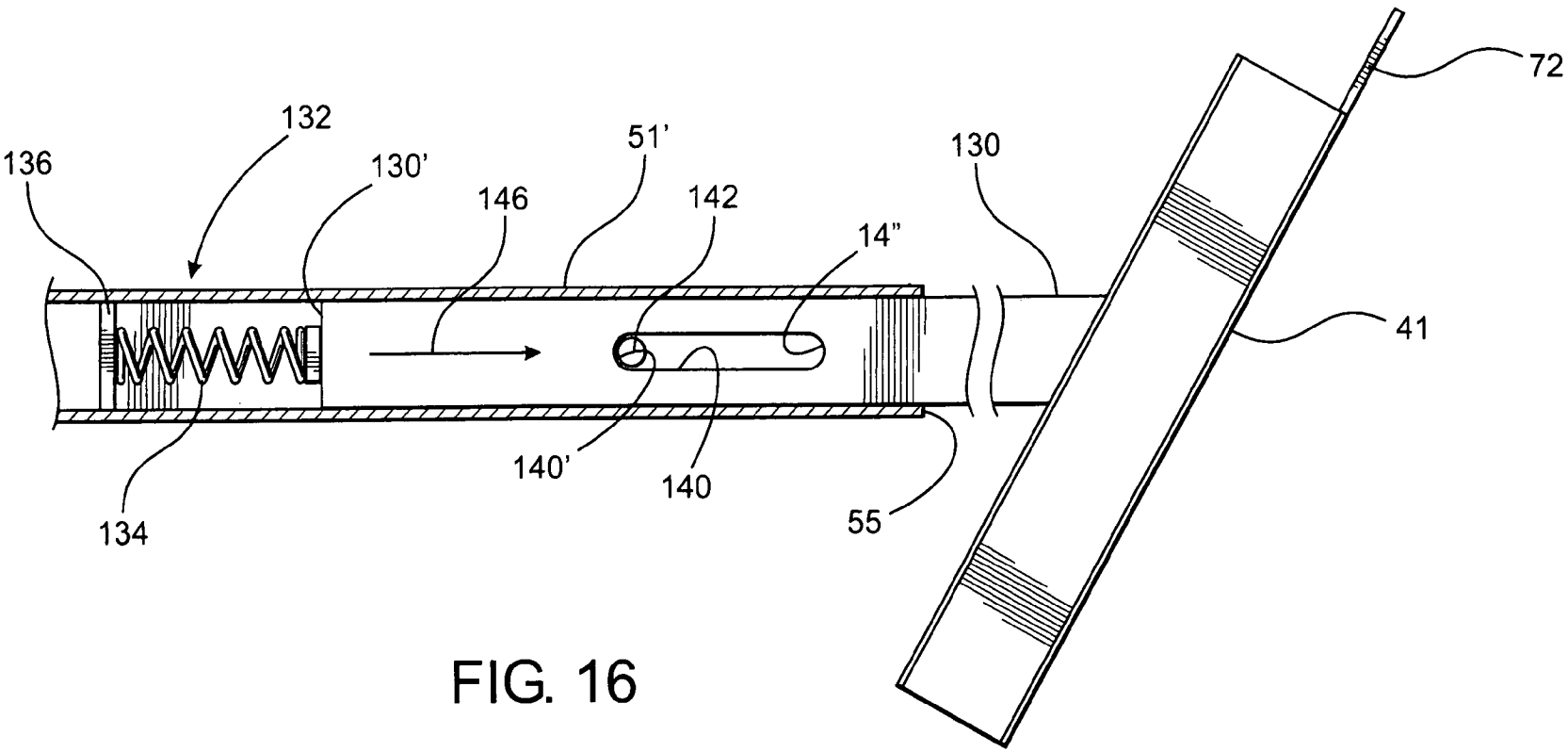
FIG. 16 is an interior side view in partial cutaway and section of the embodiment of FIG. 15.
Figure 17:
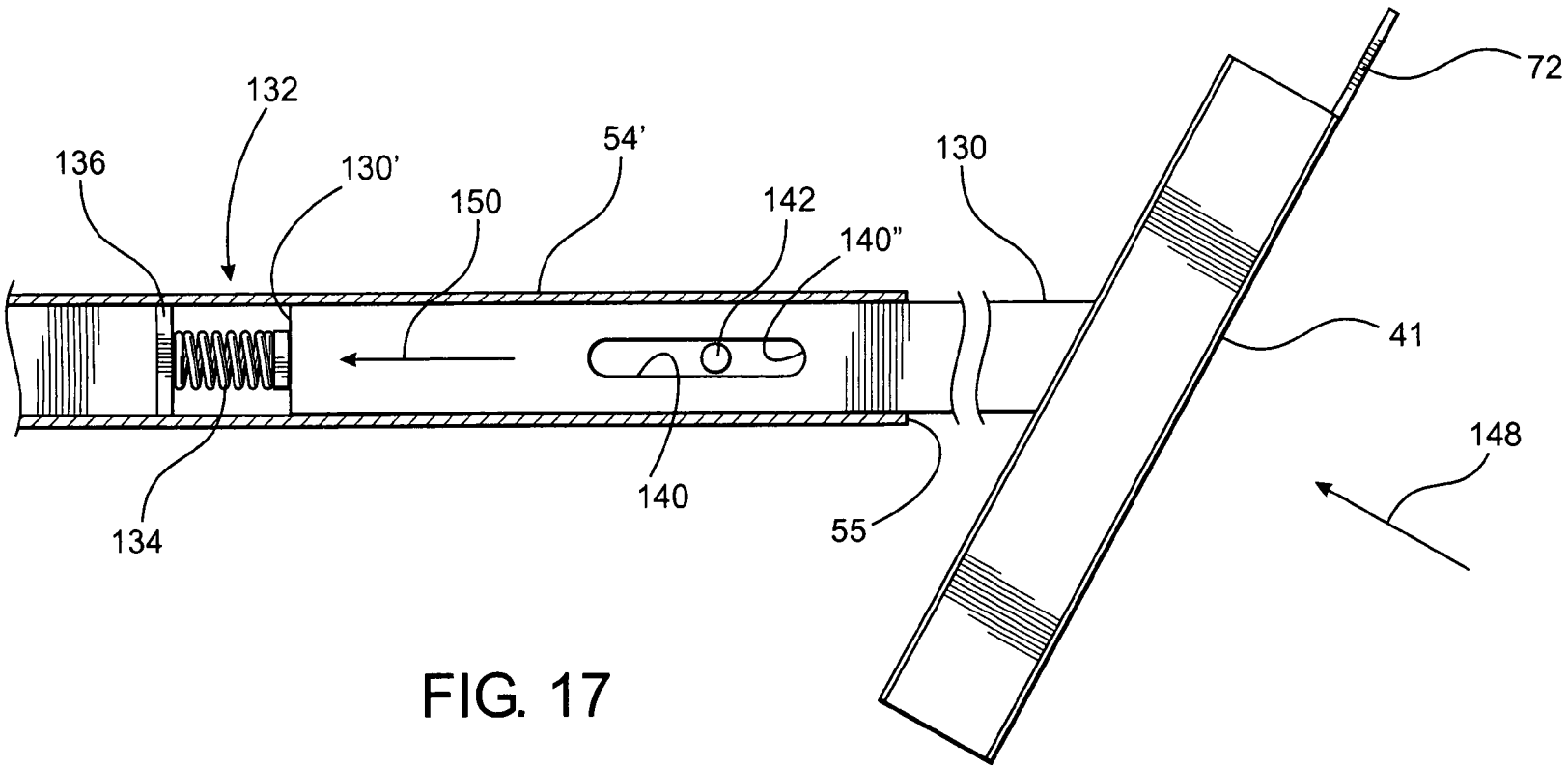
FIG. 17 is an interior side view in partial cutaway and section of the embodiments of FIGS. 15 and 16 represented in a retracted or force absorbing position.

With primary reference to FIGS. 15-17, yet another preferred embodiment of the present invention is directed to structural modifications of one or all of the support assemblies and corresponding ones of the mounting assemblies. More specifically, in the embodiments of FIGS. 1, 6, and 13 each of the mounting structures were integrally or otherwise fixedly secured to the outer end of the corresponding support arms. However, in the additional preferred embodiment of FIGS. 15-17, the mounting structure 41 is movably connected to the support arm 54' and is operatively associated with a force absorbing assembly generally indicated as 132.

It is emphasized that specific reference to only one mounting structure 41 and one support assembly and/or support arm 54' is provided for purposes of clarity and simplicity. Accordingly, any one or all of the mounting structures and corresponding ones of the support arms may have an equivalent structure as demonstrated in FIGS. 15-17. Therefore, specific reference to support arm 54', mounting structure 41 and associated components are intended to be representative of any and all of the mounting structures and their corresponding support arms which incorporate the structural and operative features of the preferred embodiment of FIGS. 15-17.

More specifically, movable connection of the mounting structure 41 to the support arm 54' is accomplished by an elongated mounting shaft 130 secured to the mounting structure 41 and dimensioned and configured to be telescopically fitted within or relative to the interior of an at least partially hollow support arm 54', as through an open end 55. In addition, the distal end of the mounting shaft 130 is disposed on the interior of the support arm 54' as best represented in FIGS. 16 and 17.

The structural and operative features of the force absorbing assembly 132 are represented in detail in FIGS. 16 and 17 and preferably comprise a biasing structure 134 which may be in the form of a coil spring or other type spring or biasing structure. The biasing structure 134 is disposed between a stop member 136 and an end or extremity portion 130' of the connecting or mounting shaft 130. The stop member 136 may be connected to support arm 54' by any appropriate means and therefore may be considered a part or portion thereof. The disposition of the biasing structure 134 and the operative features associated therewith enable the biasing structure 134 to be fixedly connected to the extremity 130' of the mounting shaft 130. As an alternative, the biasing structure 134 can be fixedly secure to the stop member 136 and be detached from but react against the end or extremity 130'.

Additional structural features further represented in FIGS. 16 and 17 is the provision of an elongated slot or equivalent structure 140 formed on or at least partially through and/or within the connecting or mounting shaft 130. The transverse dimension of the elongated slot 140 is such as to receive bolt, pin or other type of movement restricting member 142. With reference to FIG. 15 the member 142 may include a head portion 142' disposed on the exterior of the support arm 54', whereby insertion, removal and/or manipulation of the member 142 may be facilitated. Further, the member 142 has a sufficient length to pass into the interior of the support arm 54' and into and through the elongated slot 140. It should also be noted that a complete removal of member 142, through a manipulation of the head 142' may serve to release the connecting or mounting shaft 130 thereby allowing the removal of the shaft 130 from the interior of the support arm 54' and a complete detachment of the mounting structure 41 from its operative position as shown throughout FIGS. 15-17.

In operation, the mounting structure 41 is normally disposed in an at least partially, outwardly extended position as best shown in FIGS. 15 and 16. This outwardly extended position is at least partially accomplished by a biasing force exerted on the mounting shaft 130 by virtue of the placement and structuring of the biasing structure 134 relative to end 130' and stop member 136. Therefore, in its normal or initial, outwardly extended position, the mounting structure 41 and any striking target thereon are properly disposed and oriented to facilitate the striking thereof by a user of the practice assembly 10, 10', etc. The degree of outward extension and travel of the mounting structure 41 is limited by the member 142 passing through the elongated slot 140 from an exterior support arm 54' and being disposed to engage closed end 140' of the slot 140. The normally outward biasing force exerted on the mounting shaft 130 is schematically demonstrated by directional arrow 146.

However, when the striking pad (not shown for purposes of clarity) associated with the mounting structure 41 receives a blow or other force, as schematically indicated by directional arrow 148, a sufficient force is normally generated thereby to exert an inwardly directed force thereon, as schematically represented by directional arrow 150. The force 150 on the mounting structure 41 and mounting shaft 130 will be substantially opposed to the normally outwardly directed biasing force 146 exerted on the shaft 130 by the biasing structure 130. As a result the biasing structure 134 will become compressed. This compression of the biasing structure 134 will serve to at least partially absorb the force generated by the striking of the striking target on the mounting structure 41. However, the mounting structure 41 will be forced into the at least partially retracted position, represented in FIG. 17, as the mounting shaft 130 is forced further into the interior of the support arm 54'. The structure and disposition of the member 142 in the elongated slot will limit the inwardly directed travel of the mounting shaft 130 if and when it engages the closed in 140" of the elongated slot 140.

After the force 150 generated by striking the striking target on the mounting structure 41 has dissipated, the biasing force exerted on the end 130' of the mounting shaft 130 will force the mounting shaft 130 and the corresponding mounting structure 41 outwardly, as at 146, so as to again assume its normally outwardly extended position. The mounting structure and any striking target connected thereto will the thereby be immediately and repeatedly ready to receive another blow or force as the user of the practice assembly continues performance of the martial arts techniques.

Additional structural and operative features of the practice assembly 10' include the provision of at least one, but preferably a plurality of auxiliary connectors 96 disposed at various spaced apart locations on the stanchion 12, base 14, support assemblies 30 and 80 as well as other locations on the practice assembly 10'. Further, each of the auxiliary connectors 96 are structurally adapted to anchor, connect or otherwise secure one or more elongated elastic exercise bands or straps (not shown for purposes of clarity) commonly known and utilized in the exercise industry. Interconnection of the elastic bands or straps with anyone of the auxiliary connectors 96 may be accomplished by a variety of conventional devices such as a hook, snap-hook or any appropriate attachment device which facilitates removable connection of the elastic bands two any one of the auxiliary connectors 96 in a manner which allows a pulling and/or pushing tension to be exerted on the strap band, so as to provide adequate resistance to the user thereof.

Figure 7:
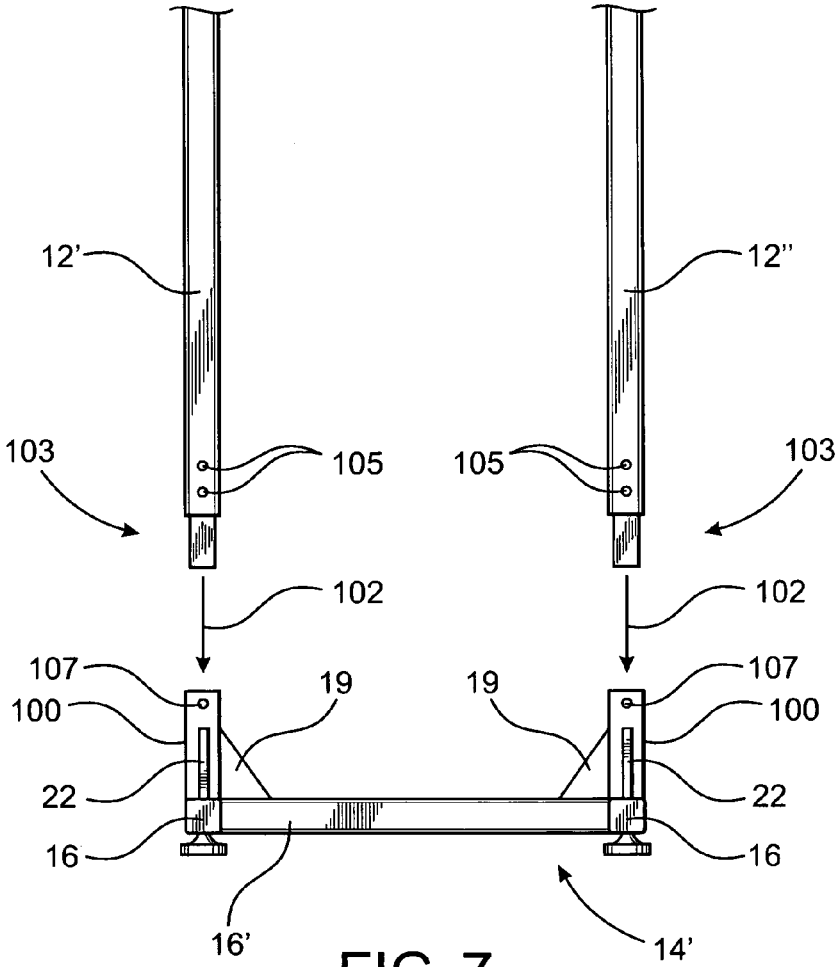
FIG. 7 is a side view of yet another preferred embodiment of a base structured to support and be removably connected to one or more stanchions.
Figure 8:
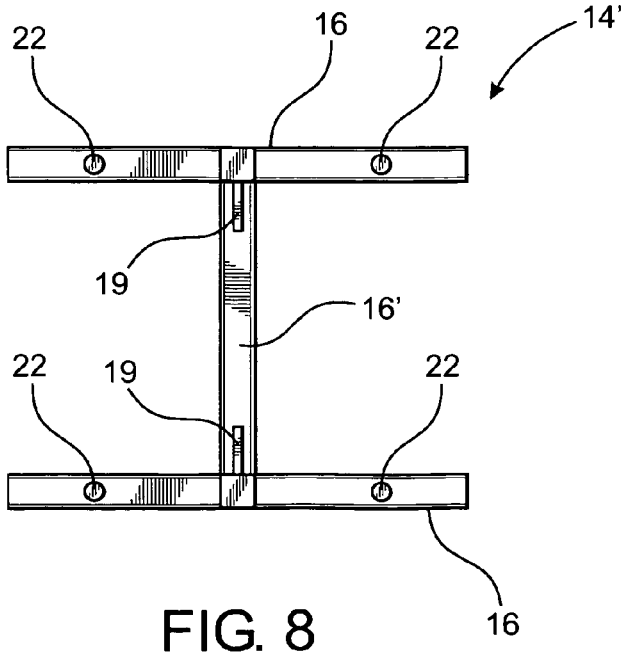
FIG. 8 is a top view of the base assembly of the embodiment of FIG. 7.

Yet another preferred embodiment of the present invention is demonstrated in FIGS. 7 and 8, wherein a base 14' is structured to be removably connected to at least one stanchion 12' or at least two stanchions 12' and 12". The lower end of each stanchion 12' and 12" is telescopically received within upstanding stanchion mounts 100 as indicated by directional arrows 102. As such, the lowermost end of each of the stanchions 12' and 12" are dimensioned, configured and otherwise structured to be received within or otherwise be removably connected to the stanchion mounts 100, as demonstrated. Further, removable interconnection of the lower ends 103 of each of the stanchions 12' and 12" with the upstanding stanchion mounts 100 may be accomplished by alignment of a plurality of apertures 105 and 107 respectively formed on the stanchions 12', 12" and the stanchion mounts 100. A spring loaded pull handle 58 and 58', as described with specific reference to FIGS. 1 and 1A, can be utilized to removably connect the stanchions 12' and 12" to the stanchion mounts 100. In the alternative, any type of locking pin, cotter pin or substantially equivalent structure can also be used to simultaneously pass into and through the stanchion mounts 100 and stanchions 12' and 12" by means of the alignment of the corresponding holes or apertures 105 and 107. Further, as with the embodiment of FIG. 6 an additional bracing flange or like member 19 may serve to interconnect the stanchion mount 100 with the base 15', as indicated.

Accordingly, the preferred embodiment of FIG. 6 including the stanchion 12 integrally or fixedly secured to the base 14 may be modified to substitute a stanchion 12' or 12" for the stanchion 12, thereby enabling a removable, supporting connection of the stanchion portion of the practice assembly 10' from the base 14 or 14'. In addition, it should be apparent that the relatively opposite disposition of the stanchions 12, 12' and/or 12" on the base 14' facilitates the concurrent use of the stanchions 12, 12' and 12", as well as the support assemblies, mounting structures and striking targets associated therewith by different users practicing at the same time. Also, a combined structure of the bases 14 and 14' may be implemented, wherein one of the stanchions 12 may be integrally or fixedly secured to the base and the other of the two stanchions, as at 12' or 12", may be removably connected to the same base.

Figure 14:
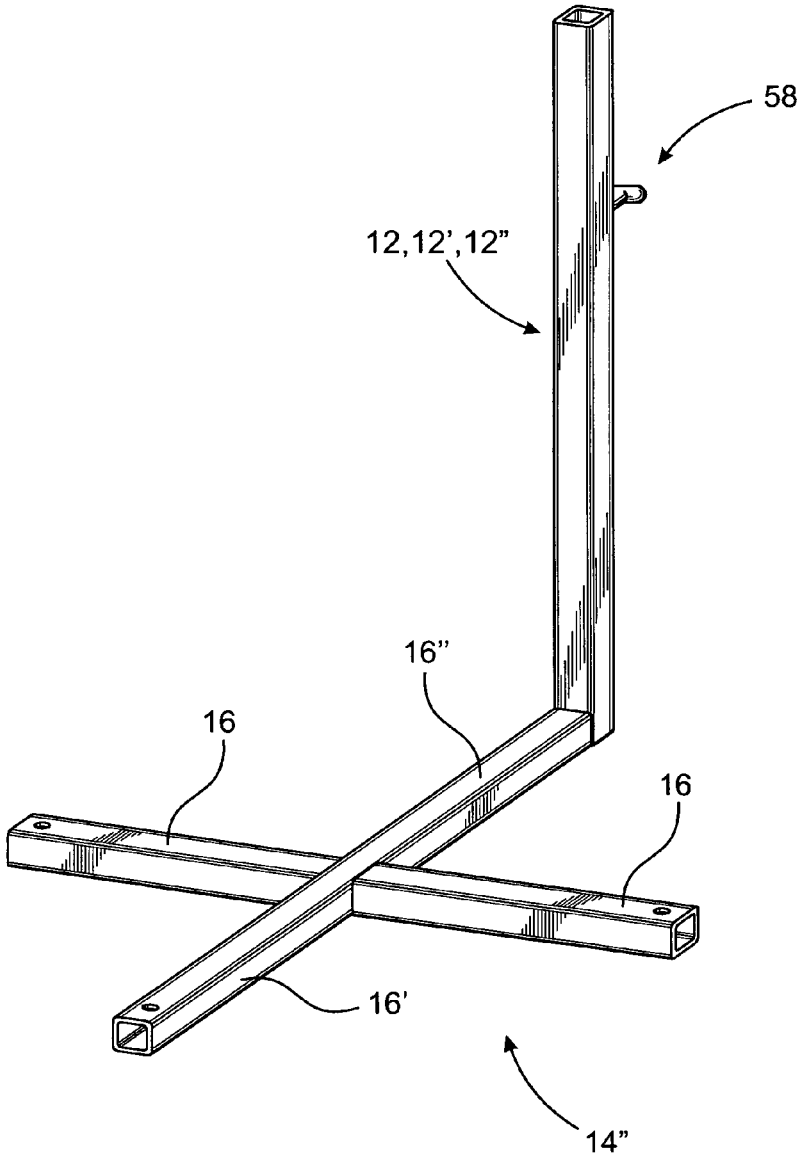
FIG. 14 is a perspective view in partial cutaway of a separable portion of a base, including a brace extension and an additional stanchion connected thereto.

Yet another preferred embodiment of the present invention is represented in FIG. 14 and comprises a modification of the separable base portion 14" to include a plurality of outstanding legs 16 as is present in the embodiment of FIG. 13. Similarly a brace segment 16' is separable from a remainder of the base 14' not shown in FIG. 14 but clearly represented in FIG. 13. A structural modification defining the additional embodiment is a brace extension 16" which may be fixedly or removably connected to any one of the stanchions 12, 12', 12", etc. As such, the brace extension 16" when connected to the other separable portion of the base 14" serves to locate the removably or fixedly attached stanchion 12, 12', 12", etc, in a laterally outward, spaced relation to the remainder of the base 14" and to an additional or primary, first stanchion 12' as represented in FIG. 13. Such an outwardly laterally spaced disposition of the stanchion 12, 12', 12", etc. may be for purposes of establishing a greater space between two or more stanchions connected to a common base so as to provide the users thereof additional or enlarged areas in which to practice various martial art techniques.

Figure 9:
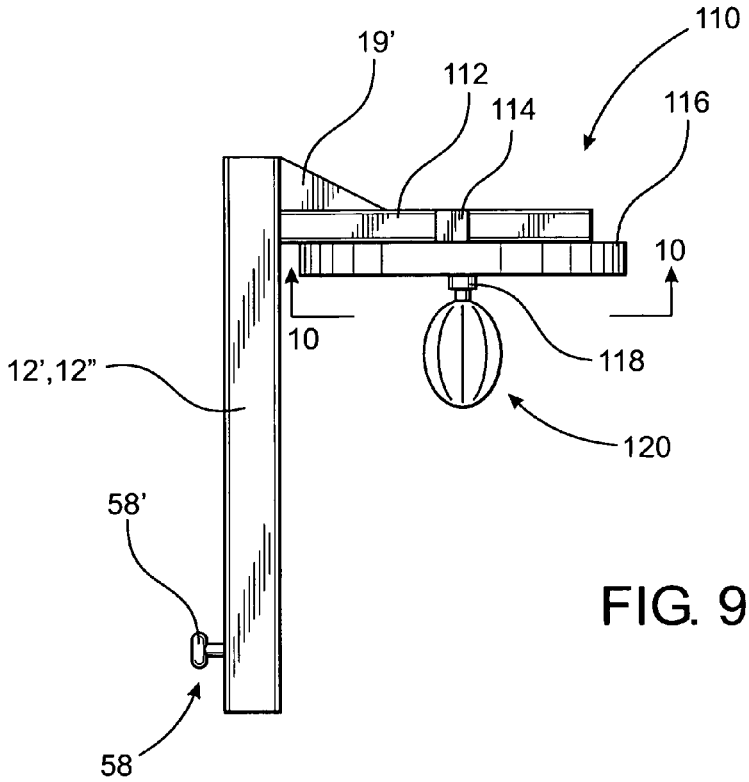
FIG. 9 is a side view of yet another preferred embodiment of the present invention including a stanchion, modified support assembly and mounting structure.
Figure 10:
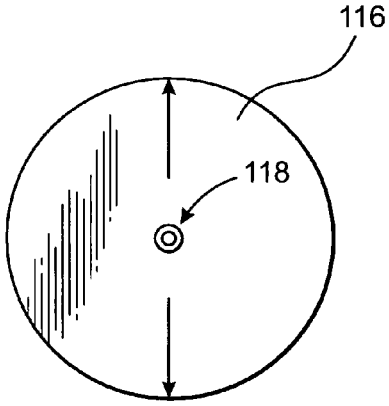
FIG. 10 is a bottom view along lines 10-10 of FIG. 9.
Figure 11:
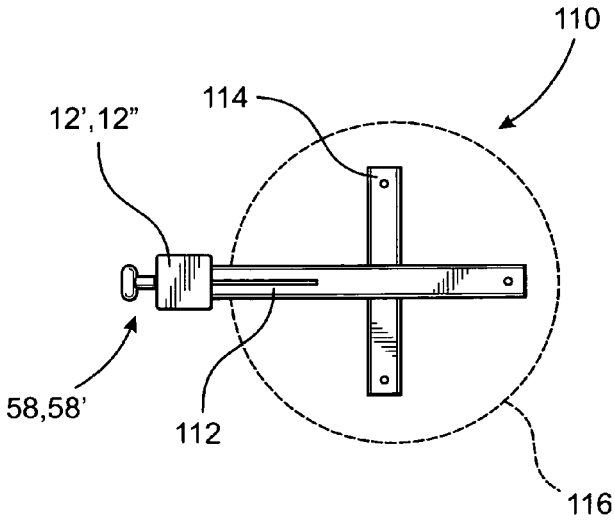
FIG. 11 is a top view in partial phantom of the embodiment of FIG. 9.

Yet another preferred embodiment of the exercise assembly of the present invention is represented in FIGS. 9 through 11. More specifically, FIG. 9 discloses a stanchion 12' or 12" capable of being removably connected to a base such as at 14' by means of a spring loaded or spring biased pull handle assembly 58, 58', as explained above with specific reference to FIGS. 1A and 6A. The additional preferred embodiment of FIG. 9 further comprises a support assembly generally indicated as 110 including an outwardly extending elongated support arm 112. The support art 112 has its proximal end connected to an upper portion of the stanchion 12', 12" and may be additionally supported by a bracing flange 19'. An additional cross brace or reinforcing member 114 is connected to the support arm 112 in a substantially transverse relation thereto as clearly demonstrated in FIG. 11.

In this additional preferred embodiment, the mounting structure comprises a panel or like structure 116 preferably, but not necessarily, having a circular configuration as clearly demonstrated in FIGS. 10 and 11. Further, the mounting structure 110 includes an attachment assembly 118 structured to movably connect a striking target, generally indicated as 120, preferably in the form of a punching bag or "speed bag" of the type well-known in the boxing industry. It is emphasized that the speed bag 120, while conventionally associated with the sport of boxing, can be utilized in the practicing of various martial art techniques. As such, the striking target or speed bag 120 can be conventionally structured or somewhat modified or customized so as to be more readily adaptable to the various martial art techniques intended to be practiced thereon. Also, the mounting structure 110 includes the panel

116 being disposed and configured to include an under surface 116' defining a deflecting portion or structure which periodically confronts or engages the speed bag 120, causing it to "bounce" or be deflected away from the panel member in a conventional manner as it is repeatedly struck.

As described above with reference to the embodiment of FIGS. 7 and 8, the preferred embodiment of FIG. 9 can be used independently of or concurrently with either of the practice assemblies 10 or 10' wherein one or more stanchions 12, 12' and/or 12" may be fixedly or removably secure to an appropriate base structure 14 or 14'.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to facilitate the practice of martial art techniques, said assembly comprising:

at least one elongated stanchion and a supporting base connected thereto, said base disposed and structured to facilitate a substantially upright, operative orientation of said stanchion on a supporting surface, a plurality of support assemblies, at least some of said support assemblies adjustably connected to said stanchion and each of said support assemblies including a mounting structure connected thereto, each of said mounting structures removably supporting a striking target in an exposed, accessible position thereon, each of said striking targets comprising an attachment assembly disposed on a rear face thereof and structured for removal connection to any one of said mounting structures, each of said attachment assemblies comprising an end portion disposed on said rear face, said end portion comprising a closed loop configuration, wherein each of said mounting structures is at least partially disposed between said rear face of a corresponding one of said striking targets and said end portion of a corresponding one of said attachment assemblies, each of said mounting structures including an adapter member disposed thereon; each of said adapter members comprising a hook shaped portion, each of said hook shaped portions disposed in removable retaining engagement with said end portion of said attachment assembly of a corresponding one of said striking targets, and said end portion of each of said attachment assemblies and said hook shaped portion of each of said adapter members cooperatively disposed to at least restrict axial displacement of corresponding ones of said striking targets relative to corresponding ones of said mounting structures.

2. An assembly as recited in claim 1 wherein each of said mounting structures comprises an elongated configuration transversely oriented relative to corresponding ones of said support assemblies, each of said adapter members connected to an outer end of a different one of said mounting structures.

3. An assembly as recited in claim 2 wherein each of said adapter members extends axially outward from a corresponding one of said mounting structure; each of said hook shaped portions formed on an outer most end of a corresponding one of said adapter members; each of said hook shaped portions being at least partially defined by a curved flange extending outwardly from said rear face of a corresponding one of said striking targets in at least partially surrounding relation to said end portion of said attachment assembly.

4. An assembly as recited in claim 3 wherein said end portion of each of said attachment assemblies comprises a handle structure disposed on an end of said rear face thereof.

5. An assembly as recited in claim 4 wherein said inwardly curved flange of each of said adapter members comprises a retention area disposed on an interior of said curve flange; said retention area disposed in removably receiving relation to a corresponding one of said handle structures.

* * * * *